US011072918B2

(12) United States Patent
McCormack et al.

(10) Patent No.: US 11,072,918 B2
(45) **Date of Patent: *Jul. 27, 2021**

(54) TOILET FLAPPER

(71) Applicant: STP Innovations, LLC, Congers, NY (US)

(72) Inventors: Sean McCormack, Congers, NY (US); Shijin Komath, Kerala (IN); Jithin Karukasseril Vijayan, Kerala (IN); Kushal P, Karnataka (IN); Somnath Hensh, Birbhum (IN)

(73) Assignee: STP INNOVATIONS LLC, Congers, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,259

(22) Filed: May 10, 2019

(65) Prior Publication Data

US 2020/0354937 A1 Nov. 12, 2020

(51) Int. Cl.
*E03D 5/02* (2006.01)

(52) U.S. Cl.
CPC ..... *E03D 5/026* (2013.01)

(58) Field of Classification Search
CPC ..... E03D 5/026
USPC ..... 4/391, 393, 390, 394–395
See application file for complete search history.

(56) References Cited

U.S. PATENT DOCUMENTS

| | | | | |
|---|---|---|---|---|
| 3,903,551 | A | 9/1975 | Johnson | |
| 4,811,432 | A | 3/1989 | Harris | |
| 5,924,143 | A | 7/1999 | Harrison | |
| 5,960,482 | A | 10/1999 | Chang | |
| 10,676,904 | B2 * | 6/2020 | McCormack | E03D 1/308 |
| 2010/0050331 | A1 | 3/2010 | Sim | |
| 2018/0340321 | A1 | 11/2018 | McCormack | |

* cited by examiner

*Primary Examiner* — Lori L Baker
(74) *Attorney, Agent, or Firm* — Botos Churchill IP Law LLP

(57) ABSTRACT

Toilet flappers having an adjustable length cord are disclosed. For example, a toilet flapper may include a frame with a guide structure. A float is connected to a bottom surface of the frame. A cap is connected to a top surface of the frame. A retractable cord reel is housed between the cap and the frame. During installation of the toilet flapper, a user can grab a hook attached to the end of the cord and pull enough of the cord out of the retractable cord reel and through the guide structure so that the user can attach the hook to, for example, a flush lever. In some embodiments, the toilet flapper includes a locking mechanism that impedes the cord from retracting back into retractable cord reel or from being pulled out of retractable cord reel by the user.

25 Claims, 26 Drawing Sheets

TOILET FLAPPER

CROSS-REFERENCE TO RELATED APPLICATIONS

This application is related to U.S. application Ser. No. 15/989,503, filed on May 25, 2018, which claims the benefit of U.S. Provisional Application Ser. No. 62/538,771, filed Jul. 30, 2017, and U.S. Provisional Application Ser. No. 62/511,986, filed May 27, 2017, the disclosures of which are hereby incorporated by reference herein.

TECHNICAL FIELD

The present disclosure generally relates to toilet flappers. For example, the present disclosure describes toilet flappers having an adjustable length cord.

BACKGROUND

A toilet is a sanitization fixture that is used for disposal of feces and urine. Nearly every household in the United States has at least one toilet. Moreover, nearly everyone in the United States uses a toilet, in one form or another. As a result, there is a large demand for toilets and accessories for toilets.

People tend to run into simple problems with their toilets. Some of the most common problems involve the toilet flapper. Conventional toilets include a bowl and a water tank mounted on top of a rear portion of the bowl. Inside the water tank, there is often a fill valve, a drain hole, and a toilet flapper. The fill valve is typically connected to a water supply line. The drain hole is typically located at the bottom of the water tank. Unless the toilet is being flushed, the toilet flapper seals the drain hole. When the toilet is flushed, the flapper is moved (typically raised) to permit water to flow from the water tank into the bowl.

Typically, the toilet flapper is connected to a flush lever with a chain. Furthermore, the flush lever is typically connected to a handle located on the outside of the water tank. A person can use the handle to pull the chain, thereby moving the toilet flapper off of the drain hole (and flush the toilet by the contents of the tank emptying through the drain hole). Often people encounter problems with their toilets because the chain gets stuck on the flapper. In some instances, this may prevent the toilet flapper from sealing the drain hole, which, in turn, prevents the water tank from filling up. People also encounter similar problems when the toilet flapper and chain get old.

Replacing a toilet flapper can be a frustrating process, in part, because the chain of a new toilet flapper needs to be adjusted before it can be properly installed. Thus, a need exists for a toilet flapper than can be installed easily and quickly.

BRIEF SUMMARY

The present disclosure describes toilet flappers having an adjustable length cord. In some embodiments, in comparison to conventional toilet flappers, the toilet flappers disclosed herein can be installed easily and quickly.

One aspect of the present disclosure relates to a toilet flapper comprising: a frame having one or more arms configured to moveably attach the toilet flapper to an overflow pipe in a water tank of a toilet; a cap positioned on a top surface of the frame; a float positioned on a bottom surface of the frame; a retractable cord reel positioned between the frame and the cap; and a locking mechanism. A cord and one or more springs are positioned in a housing of the retractable cord reel. The retractable cord reel is configured such that a user can pull at least a portion of the cord out of the housing through an opening in the housing. The one or more springs are configured to impart a retraction tension on the cord, wherein the retraction tension causes the cord to be pulled back into the housing in the absence of an opposing force that overcomes the retraction tension. The locking mechanism is configured to impart a locking tension on the cord that is equal to or greater than the retraction tension and prevents the cord from retracting back into the housing.

In some embodiments, the toilet flapper further comprises a guide structure having an aperture through which the cord may be pulled by a user. In some embodiments, the guide structure is positioned on the top surface of the frame. In some embodiments, the guide structure is positioned on the cap. In some embodiments, the guide structure is c-shaped. In some embodiments, the guide structure is o-shaped.

In some embodiments, the locking mechanism is configured to impart the locking tension through a lock pin and at least one further spring, wherein the at least one further spring is configured to push a portion of the lock pin through a further opening in the housing of the retractable cord reel. In some embodiments, a guide plate is also housed in the retractable cord reel, wherein the guide plate is connected to the cord, and wherein the locking mechanism is configured to impart the locking tension when the lock pin contacts the guide plate and impedes rotation of the guide plate. In some embodiments, the guide plate comprises one or more radial ribs. In some embodiments, the guide plate comprises one or more cutouts. In some embodiments, at least one of the cutouts has a half obround or semi oval shape.

In some embodiments, the frame further comprises a recess configured to receive the retractable cord reel. In some embodiments, the retractable cord reel is positioned between the frame and the cap in a generally vertical orientation. In some embodiments, the retractable cord reel is positioned between the frame and the cap in a generally horizontal orientation.

In some embodiments, the frame further comprises a first aperture and the float comprises a complementary second aperture, wherein the frame and the float are rotatably engaged, and wherein rotating the frame and the float relative to each other adjusts the alignment of the first and second apertures. In some embodiments, the toilet flapper further comprises a seal positioned on the bottom surface of the frame and around the float. In some embodiments, the seal is positioned above the first aperture of the frame and the second aperture of the float.

In some embodiments, the cord is a continuous line of material. In some embodiments, the cord comprises a plurality of interconnected segments of material. In some embodiments, the cord comprises a chain having a plurality of links.

BRIEF DESCRIPTION OF DRAWINGS

FIG. 2(*b*) illustrates a user installing the toilet flapper of FIG. 2(*a*).

FIG. 2(*c*) illustrates another embodiment of a user installing the toilet flapper of FIG. 2(*a*).

FIG. 3(*b*) illustrates a hook, cord, and locking mechanism of the toilet flapper of FIG. 3(*a*).

FIG. 3(*c*) illustrates a cord and locking mechanism of the toilet flapper of FIG. 3(*a*).

FIG. 5(*b*) is an exploded view of the toilet flapper of FIG. 5(*a*).

FIG. 5(*c*) is a perspective view of a frame and a float of the toilet flapper of FIG. 5(*a*).

FIG. 5(*d*) is an end view of the frame and the float of the toilet flapper of FIG. 5(*a*).

FIG. 6(*b*) is an exploded view of a frame and a cover of the toilet flapper of FIG. 6(*a*).

FIG. 6(*c*) is a cross-sectional view of the toilet flapper of FIG. 6(*a*).

FIG. 6(*d*) is a magnified view of a portion of FIG. 6(*c*).

FIG. 7(*b*) is an exploded view of a frame and a cover of the toilet flapper of FIG. 7(*a*).

FIG. 7(*c*) is a cross-sectional view of the toilet flapper of FIG. 7(*a*).

FIG. 7(*d*) is a magnified view of a portion of FIG. 7(*c*).

FIG. 7(*e*) is a cross-sectional view of the toilet flapper of FIG. 7(*a*) attached to an overflow pipe of a toilet.

FIG. 7(*f*) illustrates a retractable cord reel, a spring, and a lock pin of the toilet flapper of FIG. 7(*a*).

FIG. 7(*g*) illustrates a guide plate of the toilet flapper of FIG. 7(*a*).

FIG. 7(*h*) illustrates a portion of the toilet flapper of FIG. 7(*a*) in a locked position.

FIG. 7(*i*) illustrates a portion of the toilet flapper of FIG. 7(*a*) in an unlocked position.

FIG. 9(*b*) illustrates the retractable cord reel of FIG. 9(*a*) in a locked position.

FIG. 9(*c*) illustrates the retractable cord reel of FIG. 9(*a*) in an unlocked position.

FIG. 10(*b*) illustrates the retractable cord reel of FIG. 10(*a*) in a locked position.

FIG. 10(*c*) illustrates the retractable cord reel of FIG. 10(*a*) in an unlocked position.

FIG. 12(*b*) illustrates how the mechanism of FIG. 12(*a*) may be used with one type of flush lever.

FIG. 12(*c*) illustrates how the mechanism of FIG. 12(*a*) may be used with a different type of flush lever than that illustrated in FIG. 12(*b*).

FIG. 13(*b*) illustrates a hook that may be used to attach a cord of a device to the toilet flapper of FIG. 13(*a*).

FIG. 14(*b*) illustrates the lock chain and ring of FIG. 14(*a*) that may be used to attach a cord of a device to the toilet flapper of FIG. 14(*a*).

FIG. 15(*b*) illustrates a lock and a tightening ring used to attach a cord of a device to the toilet flapper of FIG. 14(*a*).

FIG. 16(*b*) is a cross-sectional view of the lock and tightening ring of FIG. 16(*a*) along line A-A.

FIG. 17(*b*) is a cross-sectional view of a clip that may be used to attach a cord of a device to the toilet flapper of FIG. 17(*a*).

DETAILED DESCRIPTION

Figure 1:
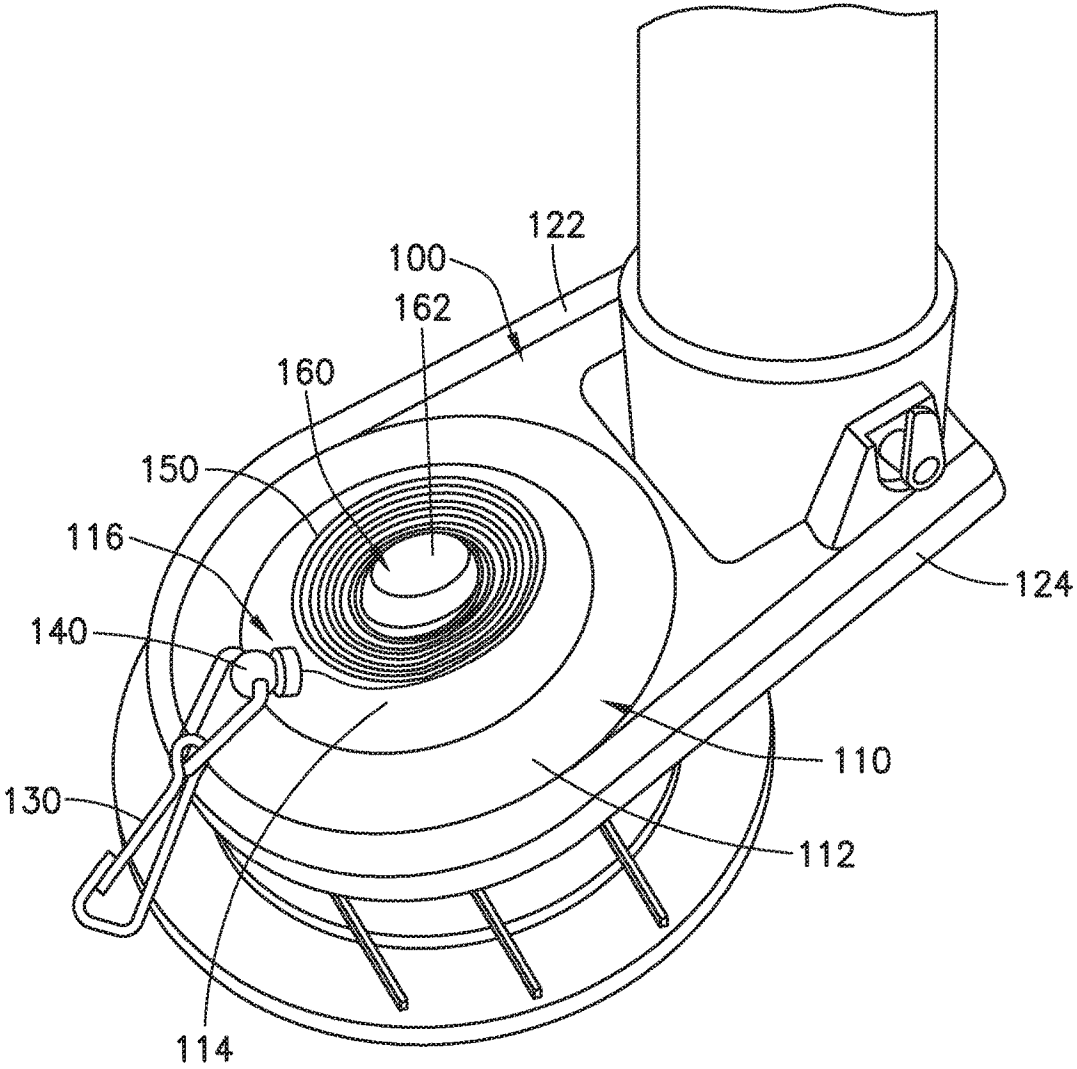
FIG. 1 illustrates an embodiment of a toilet flapper as described herein.

Embodiments of the present disclosure are described in detail with reference to the drawing figures wherein like reference numerals identify similar or identical elements. It is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

FIG. 1 illustrates an embodiment of a toilet flapper. As shown, toilet flapper 100 includes body 110, arm 122, arm 124, hook 130, ball 140, cord 150, and locking mechanism 160. Arms 122 and 124 may be used to moveably attach toilet flapper 100 to an overflow pipe near the drain hole of the water tank of a toilet. One skilled in the art is aware of the many known different configurations for attaching the toilet flapper so that it can be raised from and lowered onto the drain hole. Such configurations are not exhaustively described herein. Body 110 has a top surface 112 and a bottom surface (not shown). The top surface 112 includes a raised portion 114. Cord 150 and locking mechanism 160 are located inside raised portion 114. However, as shown in FIG. 1, the inside of raised portion 114 is exposed. In some embodiments, the inside of raised portion 114 may extend vertically below the entirety of top surface 112.

In some embodiments, body 110, arm 122, and/or arm 124 may be constructed with a rubber material. Furthermore, in some embodiments, hook 130, ball 140, and/or cord 150 may be constructed with a water-resistant material, such as stainless steel or plastic. Moreover, in some embodiments, cord 150 may be constructed as one continuous line of material and, in other embodiments, cord 150 may have one or more discontinuities, such as a chain comprising a plurality of links.

In order to install toilet flapper 100, a user can grab hook 130 and pull a portion of cord 150 out of raised portion 114. As shown, cord 150 can be pulled out of raised portion 114 through hole 116. In this embodiment, locking mechanism 160 has a button 162 and a spring (not shown). The spring provides a force that pulls cord 150 into raised portion 114. However, the force of the spring can be overcome by a user pulling cord 150 out of raised portion 114. In some embodiments, the spring may be positioned inside locking mechanism 160 beneath button 162. In some embodiments, the spring may be a spiral torsion spring. In some embodiments, the spring may cooperate with one or more other springs inside locking mechanism 160 in order to provide a force that pulls cord 150 into raised portion 114. After a user has connected hook 130 to, for example, a flush lever, the user can push down on raised portion 114 in order to push down button 162 and activate locking mechanism 160. Pushing down button 162 locks the current length of cord 150 and keeps a slack free line going from toilet flapper 100 to the flush lever. Subsequently, the user can push down on button 162, again, in order to release cord 150 for additional adjustments.

Various modifications can be made to toilet flapper 100. For example, in this embodiment, ball 140 provides a secure connection between hook 130 and cord 150. However, in other embodiments, other types of mechanisms can be used to connect hook 130 and cord 150. As another example, in this embodiment, raised portion 114 is circular and positioned centrally on the top surface 112 of body 110. However, in other embodiments, raised portion 114 can have a different shape or be located in a different position. As yet another example, in this embodiment, cord 150 is positioned in a spiral formation within raised portion 112 and locking mechanism 160 is centrally positioned within raised portion 114. However, in other embodiments, cord 150 and locking mechanism 160 can be positioned differently within raised portion 114.

Figure 2A:
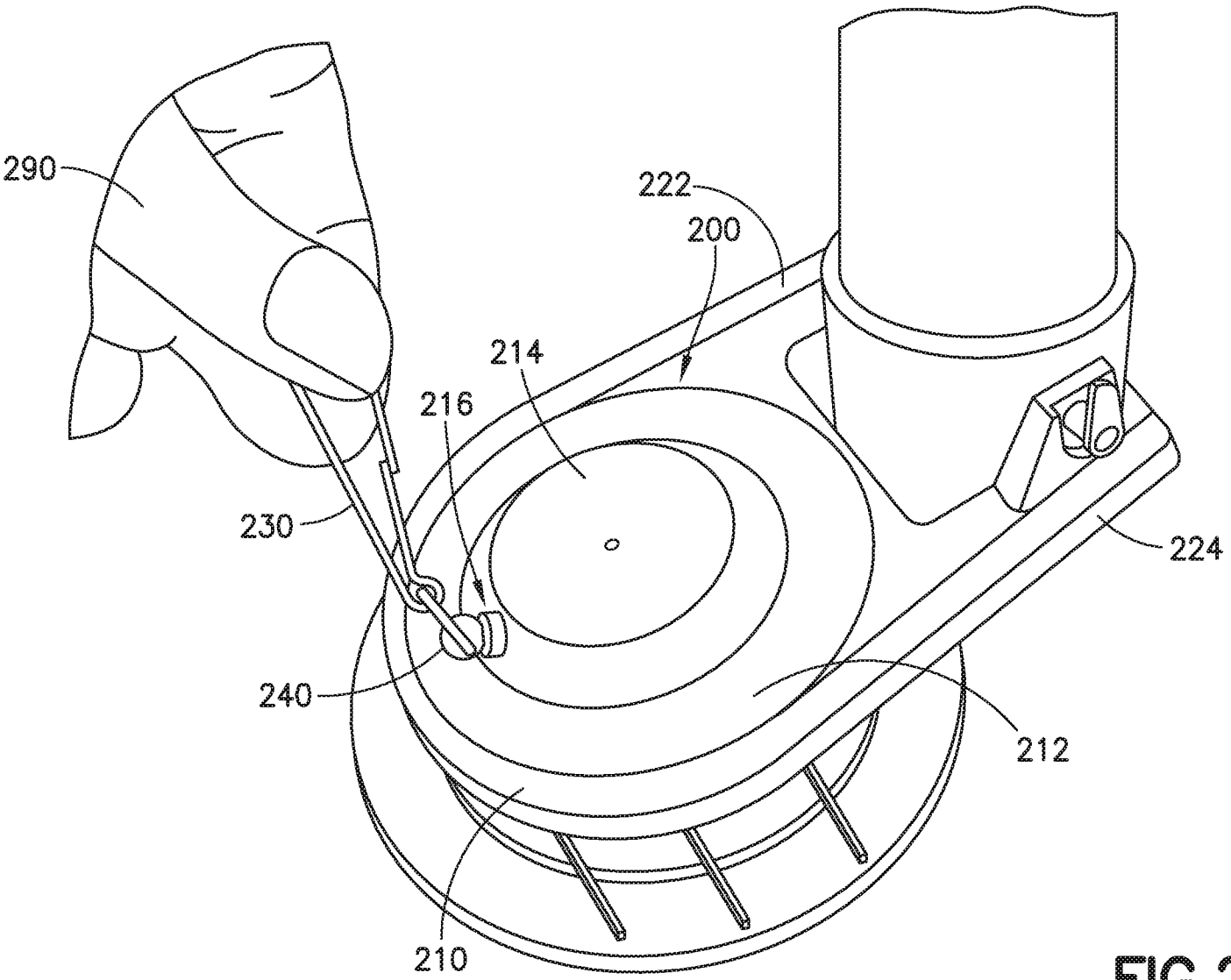
FIG. 2(*a*) illustrates an embodiment of a toilet flapper as described herein.
Figure 2B:
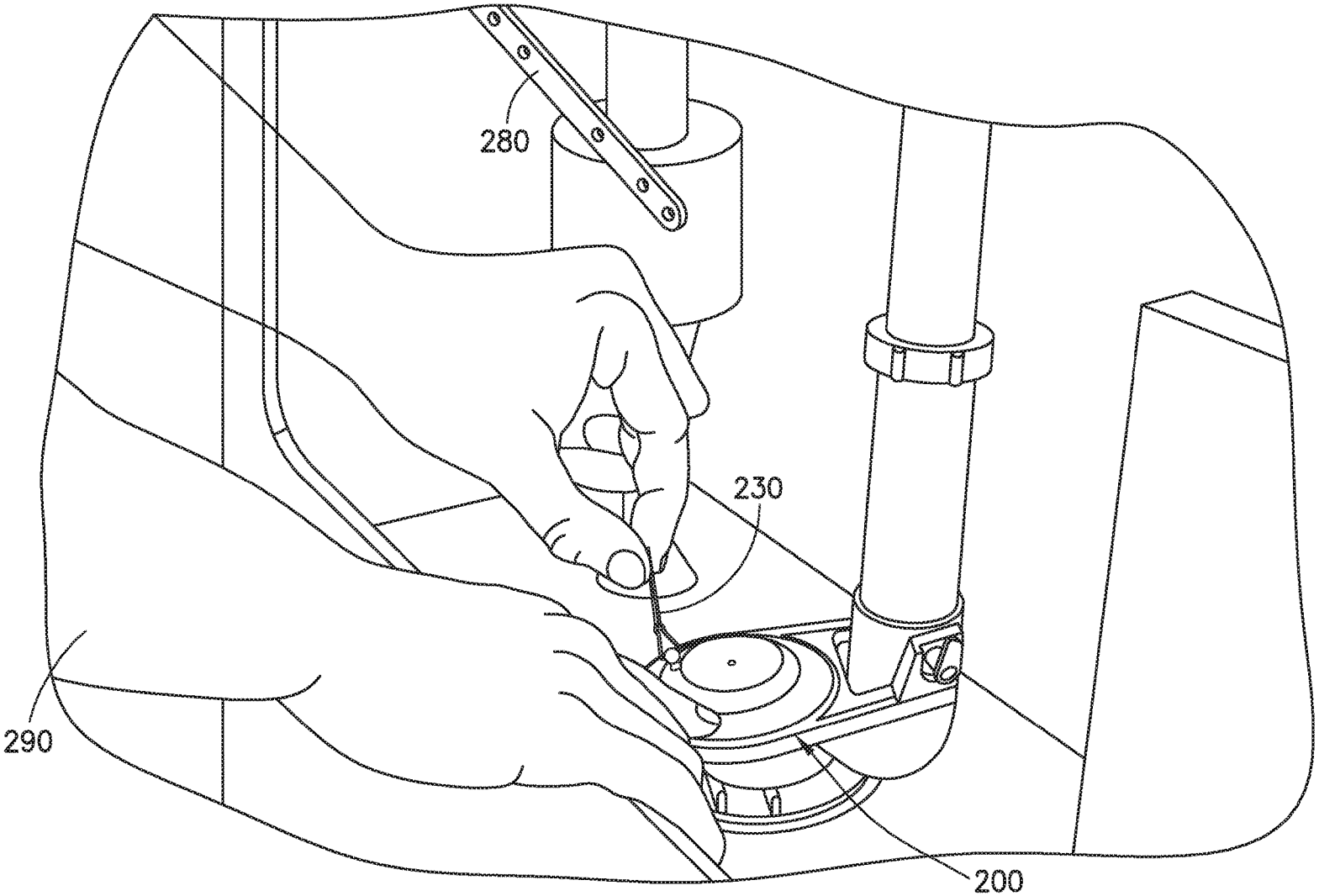
Figure 2C:
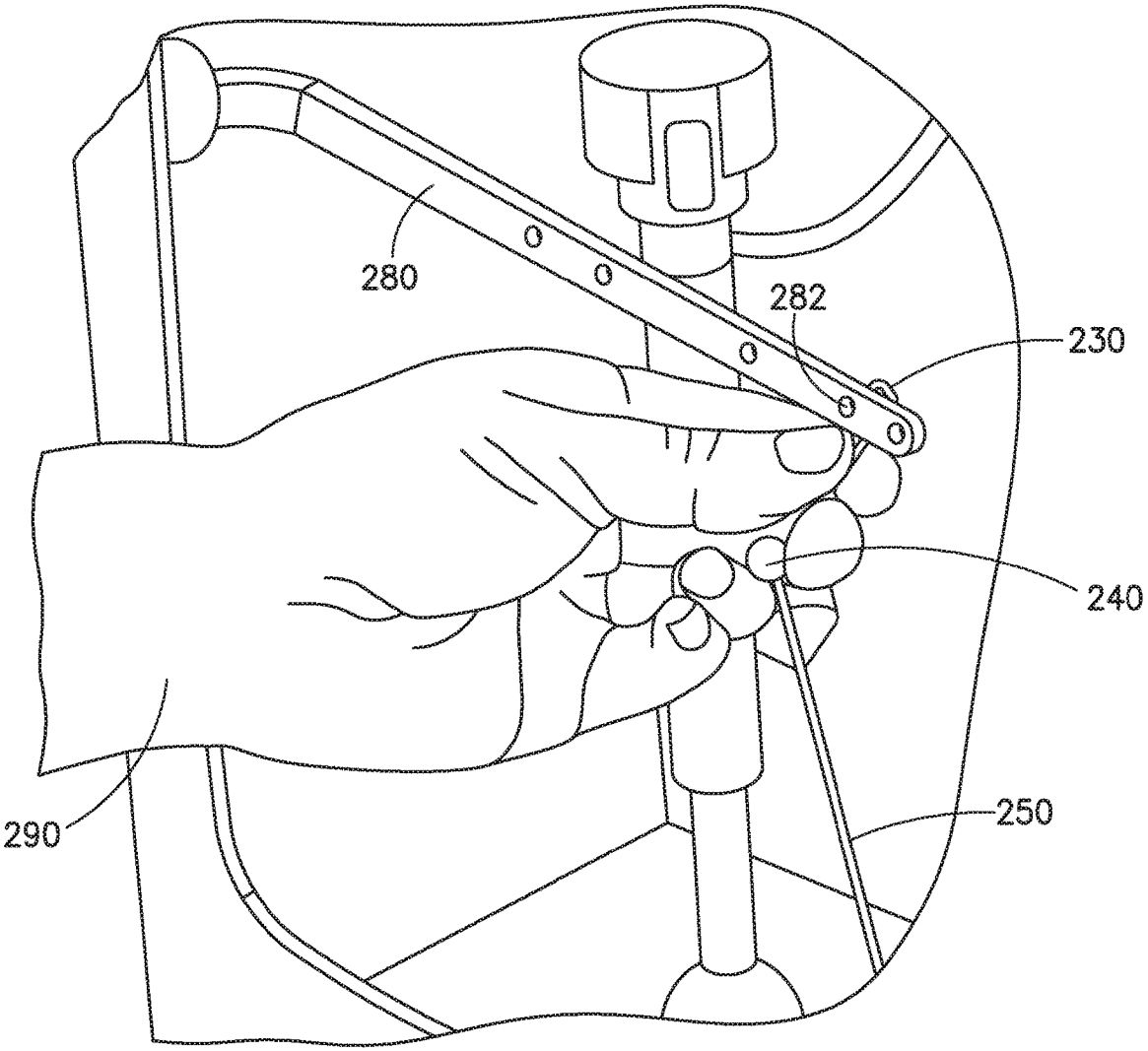

FIGS. 2(*a*)-(*c*) illustrate a user installing an embodiment of a toilet flapper that is similar to toilet flapper 100 of FIG. 1 into a toilet. As shown, toilet flapper 200 includes body 210, arm 222, arm 224, hook 230, ball 240, and cord 250. Arms 222 and 224 may be used to moveably attach toilet flapper 200 to an overflow pipe near the drain hole of the water tank of a toilet. Body 210 has a top surface 212 and a bottom surface (not shown). The top surface 212 includes a raised portion 214. As shown in FIG. 2(*a*), cord 250 is rolled up inside of raised portion 214. Much like raised portion 114 of FIG. 1, raised portion 214 also houses a locking mechanism and a spring. The spring provides a force that pulls cord 250 into raised portion 214. Furthermore, when activated, the locking mechanism impedes the spring from pulling more of cord 250 back into raised portion 214.

As shown in FIGS. 2(*a*)-(*b*), in order to install toilet flapper 200, user 290 can grab hook 230 and pull a portion of cord 250 out of raised portion 214. As shown, cord 250 can be pulled out of raised portion 214 through hole 216. As shown in FIG. 2(*b*), user 290 may hold down toilet flapper 200 during this process in order to prevent it from lifting. As shown in FIG. 2(*c*), user 290 can pull just enough of cord 250 out of raised portion 214 in order to attach hook 230 to flush lever 280 through hole 282. After hook 230 is attached to flush lever 280, user 290 can activate the locking mechanism inside raised portion 214 by pushing down on raised portion 214. By doing so, user 290 can prevent the spring inside raised portion 214 from pulling any more of cord 250 back into raised portion 214.

Figure 3A:
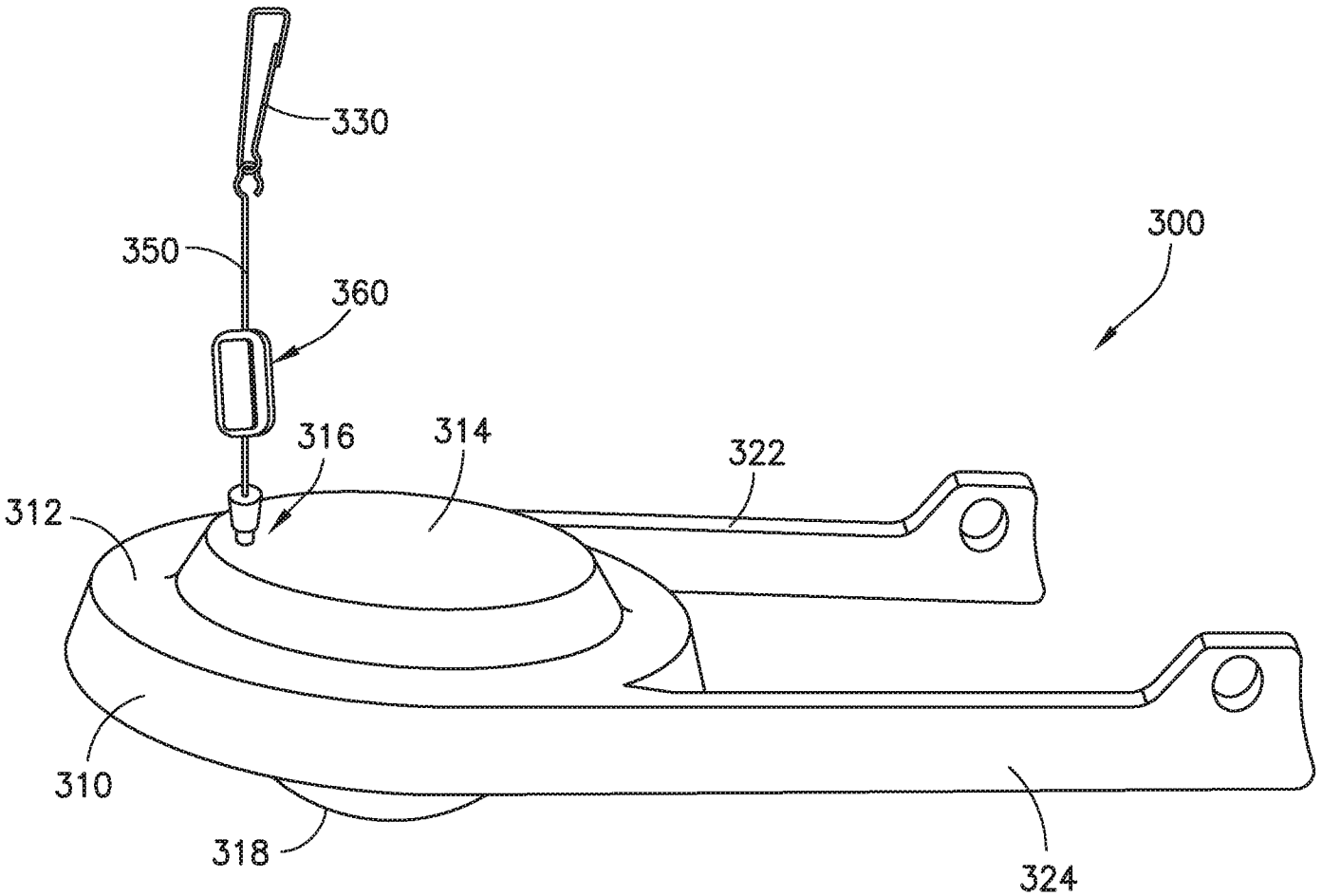
FIG. 3(*a*) illustrates an embodiment of a toilet flapper as described herein.
Figure 3B:
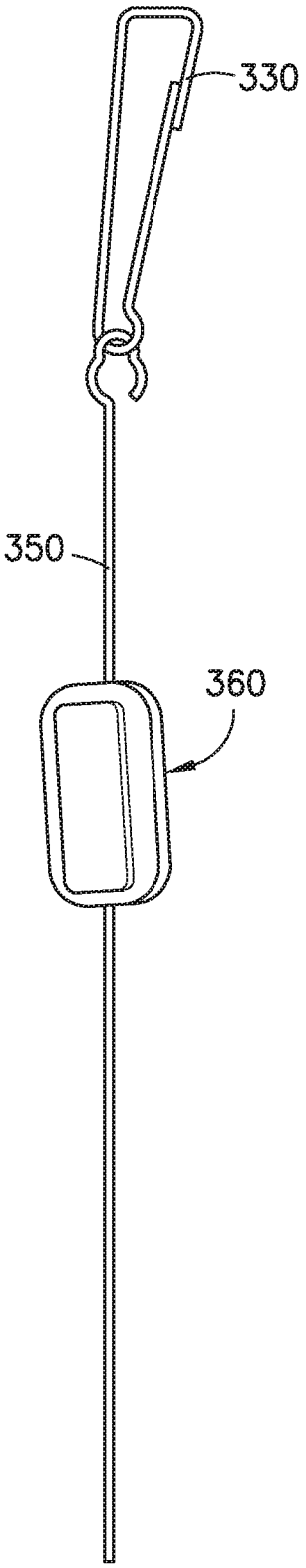
Figure 3C:
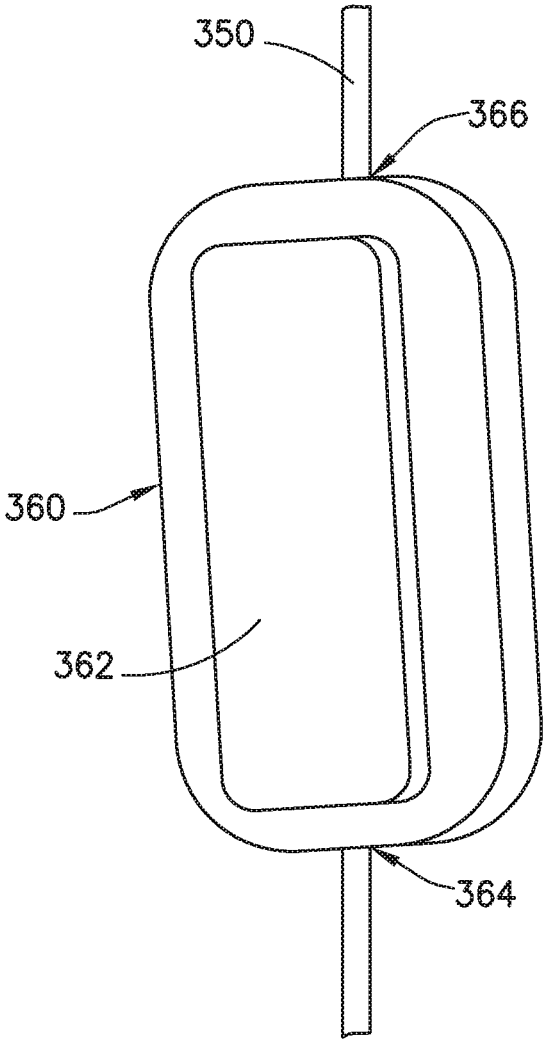

FIGS. 3(*a*)-(*c*) illustrate another embodiment of a toilet flapper. As shown, toilet flapper 300 includes body 310, arm 322, arm 324, hook 330, cord 350, and locking mechanism 360. Arms 322 and 324 may be used to moveably attach toilet flapper 300 to an overflow pipe near the drain hole of the water tank of a toilet. Body 310 has a top surface 312 and a bottom surface 318. The top surface 312 includes a raised portion 314. As shown, a portion of cord 350 is rolled up inside of raised portion 314. Raised portion 314 also houses a spring that provides a force that pulls cord 350 into raised portion 314.

In contrast to the embodiments of FIG. 1 and FIGS. 2(*a*)-(*c*), locking mechanism 360 is located outside of raised portion 314. More specifically, locking mechanism 360 is attached to a portion of cord 350 that is located outside of raised portion 314. As best shown in FIG. 3(*c*), in this embodiment, locking mechanism 360 includes button 362, inlet 364, and outlet 366. Cord 350 passes through locking mechanism 360 via inlet 364 and outlet 366. Inside locking mechanism 360, there are one or more springs. When button 362 is not being pressed, these springs impede locking mechanism 360 from sliding up or down along cord 350. However, when button 362 is pressed by a user, locking mechanism 360 can slide freely up and down the portion of cord 350 that is outside of raised portion 314 of toilet flapper 300.

In order to install toilet flapper 300, a user grabs hook 330 and pulls a portion of cord 350 out of raised portion 314 of toilet flapper 300. As shown, cord 350 can be pulled out of raised portion 314 through hole 316. After the user has connected hook 330 to, for example, a flush lever, the user can push down on button 362 and slide locking mechanism 360 down cord 350 so that it is touching hole 316. Once locking mechanism 360 is touching hole 316, the user can release button 362. By moving locking mechanism 360 down cord 350 so that it is touching hole 316, a user can prevent the spring inside raised portion 314 from pulling more of cord 315 back into raised portion 314. However, in some instances, a user may want the spring inside raised portion 314 to pull some of cord 350 back into raised portion 314. In such instances, a user may only slide locking mechanism 360 down a portion of cord 350 that is outside of raised portion 314. As a result, the portion of cord 350 that is between locking mechanism 360 and hole 316 will eventually be pulled back into raised portion 314 by the spring inside raised portion 314.

Figure 4:
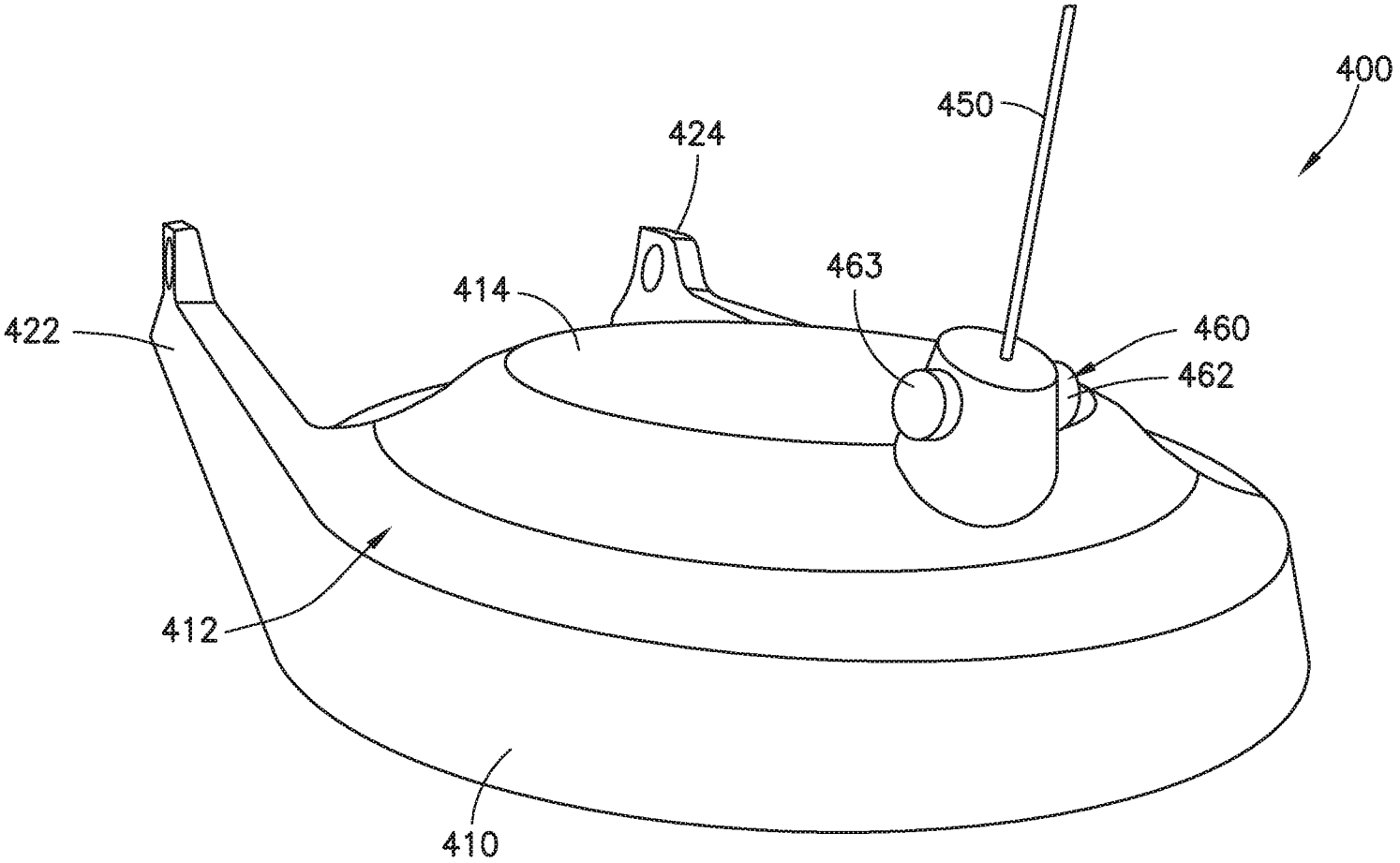
FIG. 4 illustrates an embodiment of a toilet flapper as described herein.
Figure 5A:
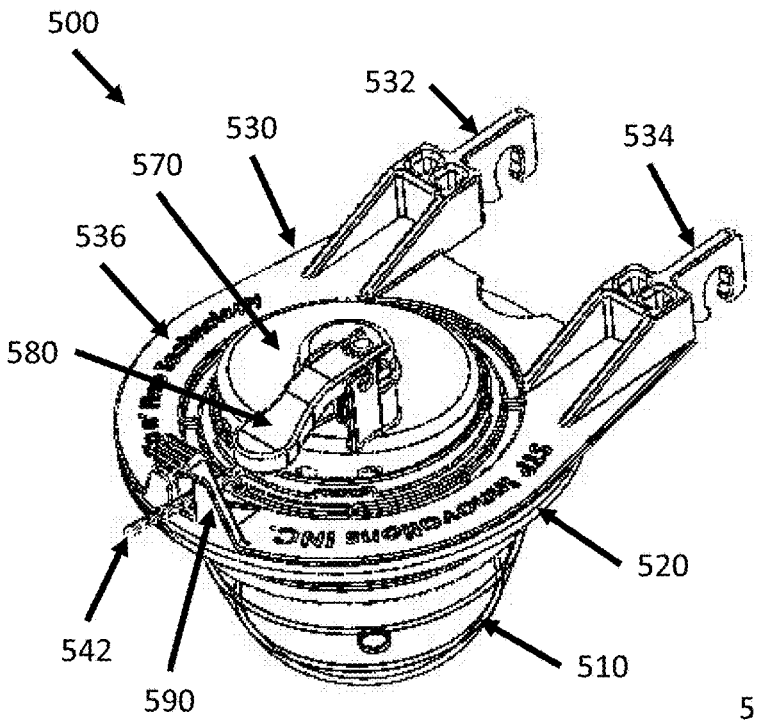
FIG. 5(*a*) illustrates an embodiment of a toilet flapper as described herein.
Figure 5B:
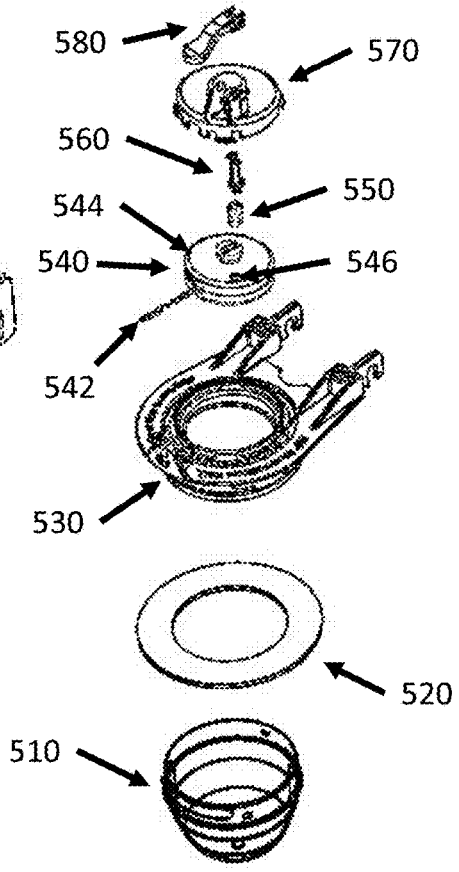
Figure 5C:
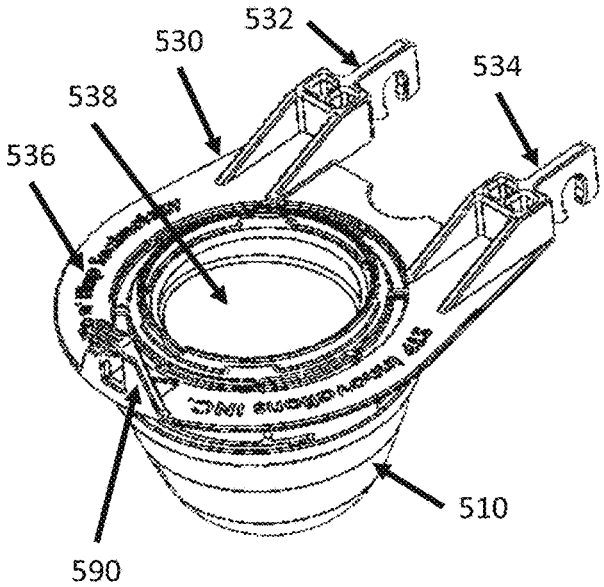
Figure 5D:
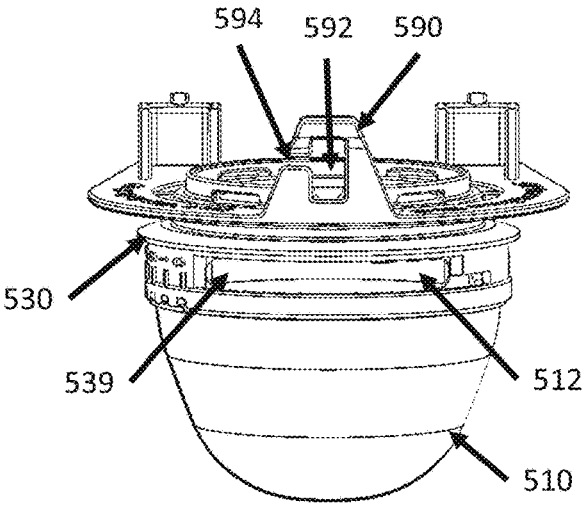
Figure 6A:
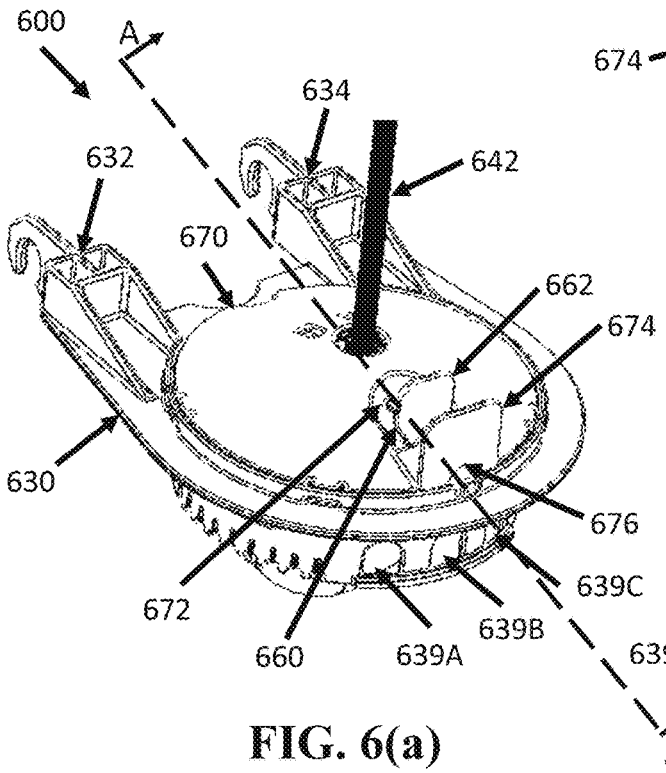
FIG. 6(*a*) illustrates an embodiment of a toilet flapper as described herein.
Figure 6B:
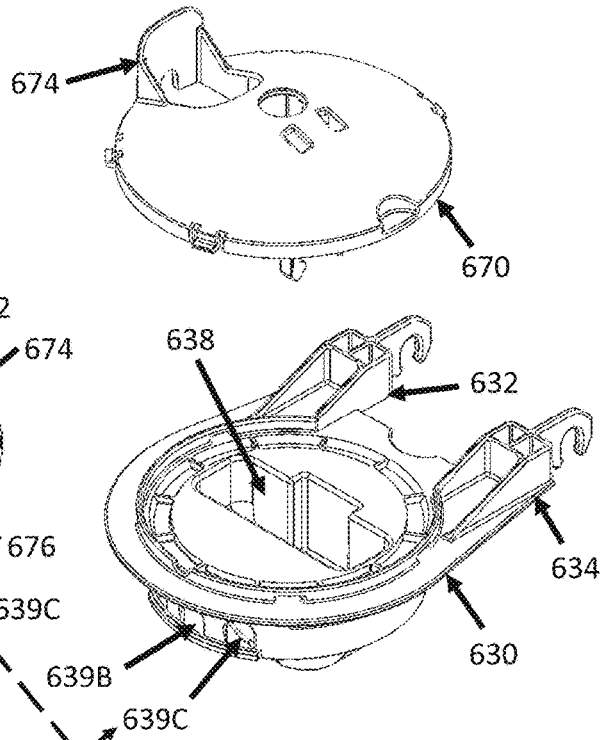
Figure 6C:
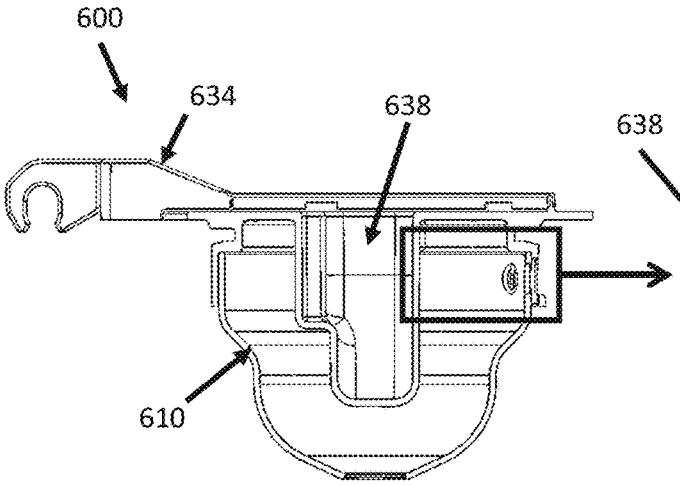
Figure 6D:
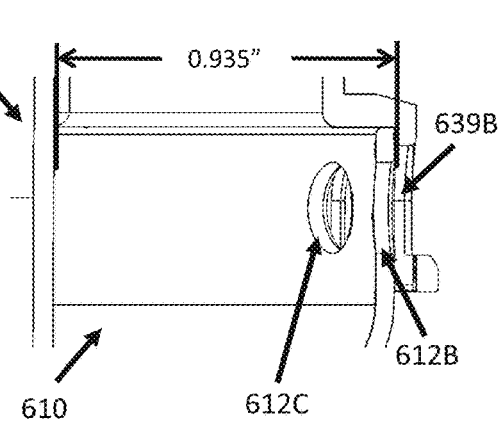
Figure 7A:
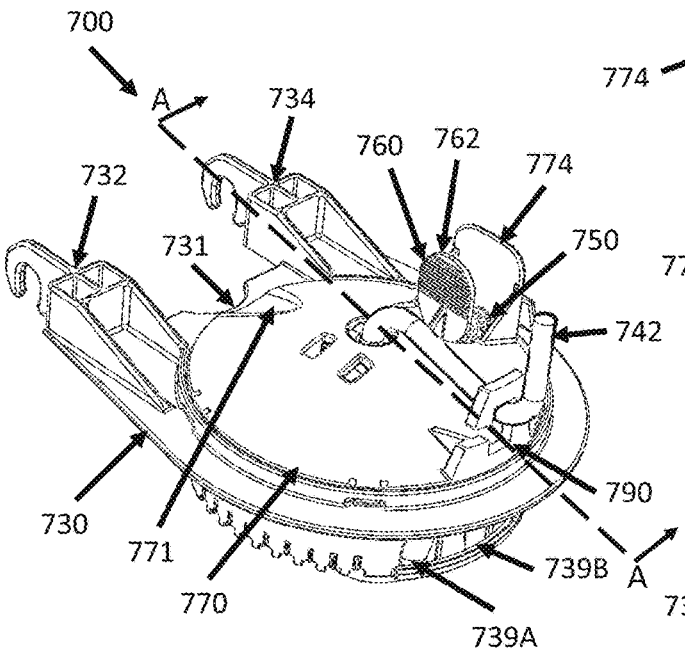
FIG. 7(*a*) illustrates an embodiment of a toilet flapper as described herein.
Figure 7B:
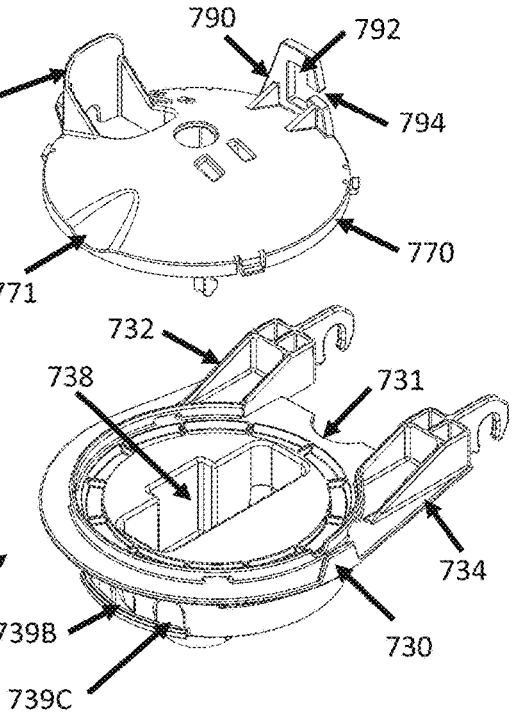
Figure 7C:
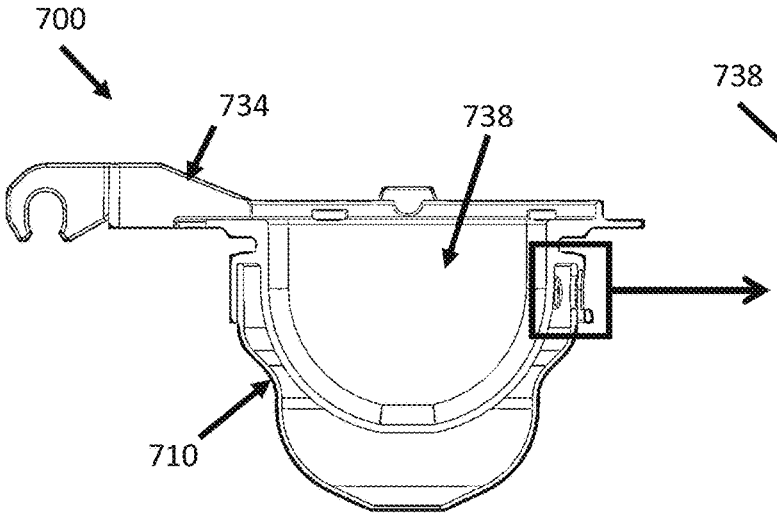
Figure 7D:
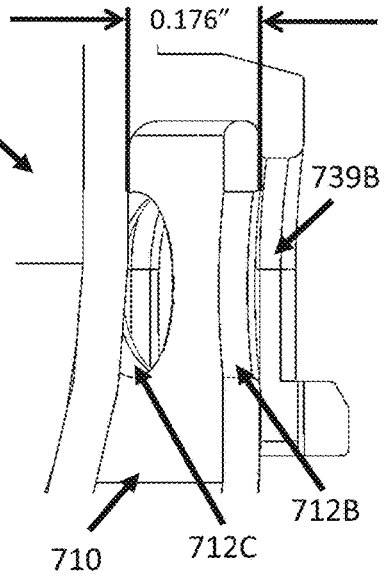
Figure 7E:
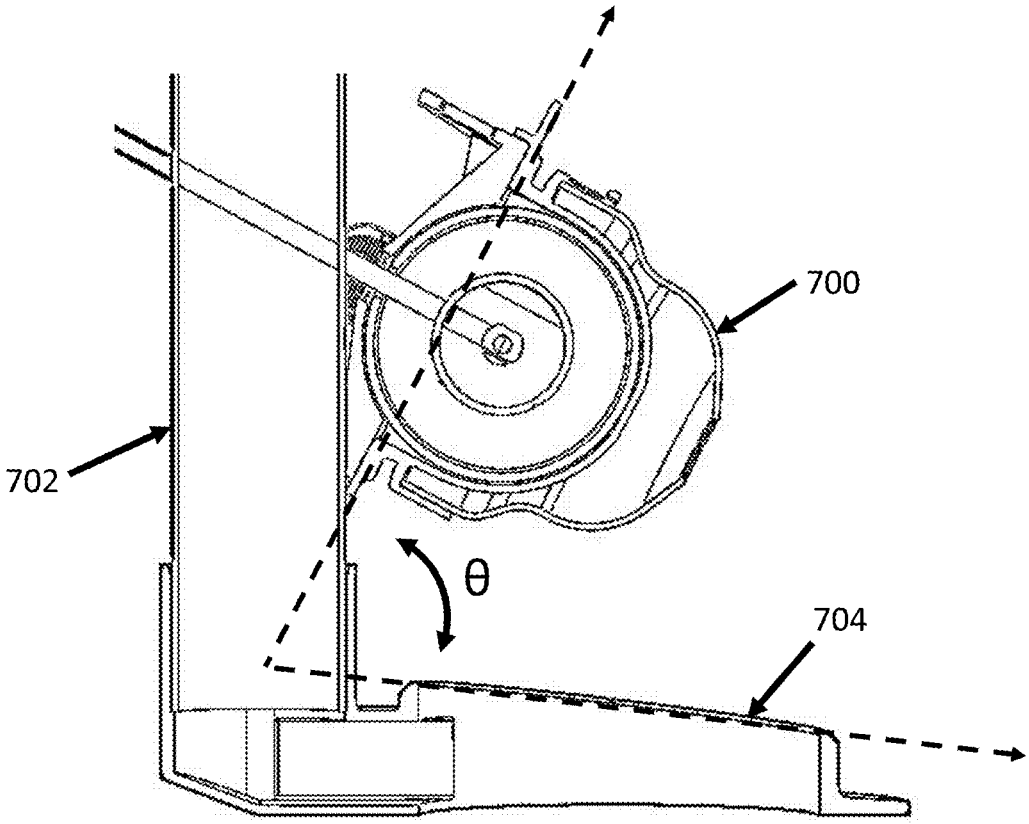
Figure 7F:
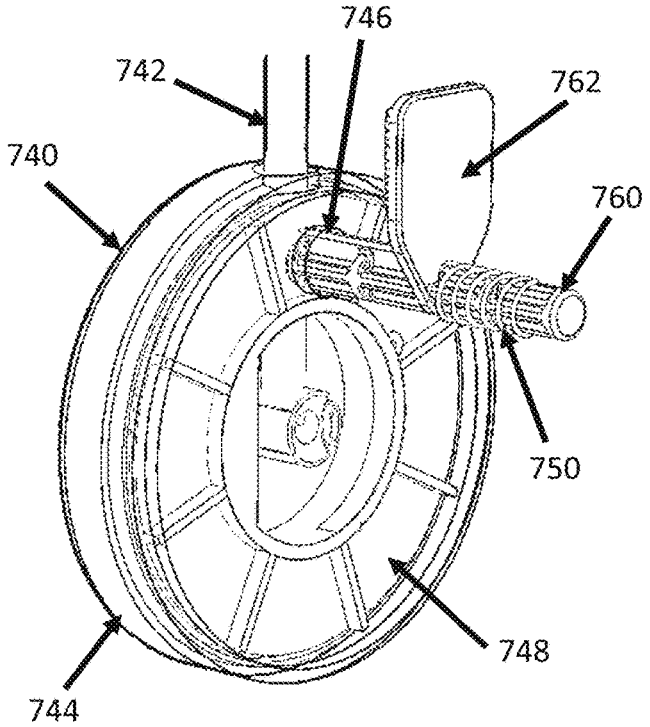
Figure 7G:
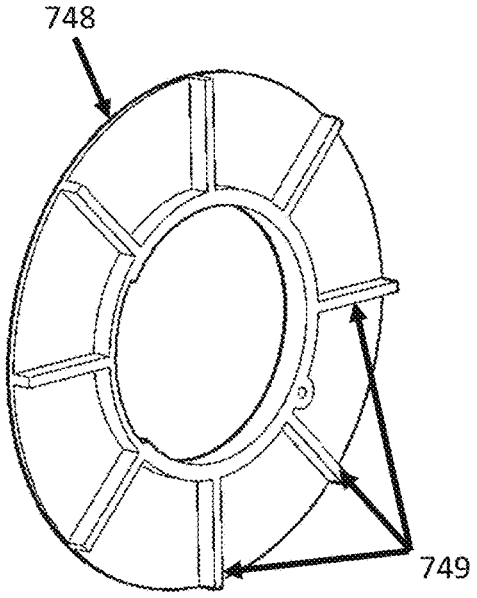
Figure 7H:
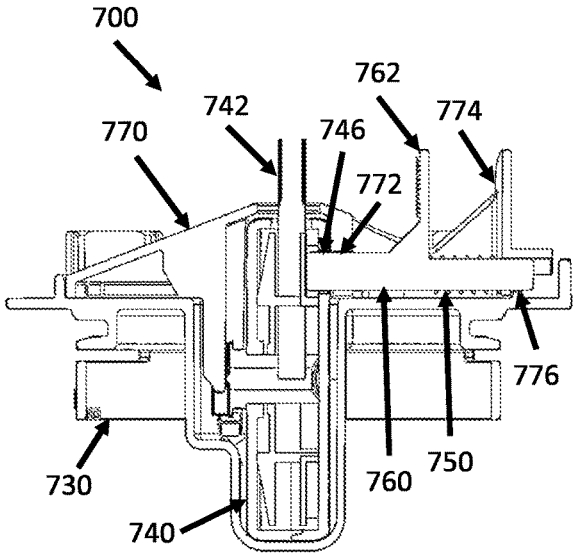
Figure 7I:
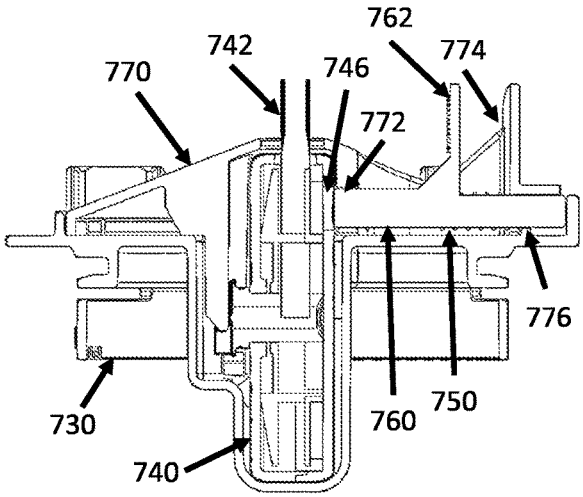

FIG. 4 illustrates another embodiment of a toilet flapper. As shown, toilet flapper 400 includes body 410, arm 422, arm 424, cord 450, and locking mechanism 460. Arms 422 and 424 may be used to moveably attach toilet flapper 400 to an overflow pipe near the drain hole of the water tank of a toilet. Body 410 has a top surface 412 and a bottom surface (not shown). The top surface 412 includes a raised portion 414. As shown, a portion of cord 450 is rolled up inside of raised portion 414. Raised portion 414 also houses a spring that provides a force that pulls cord 450 into raised portion 314.

The embodiment of FIG. 4 is similar to the embodiment of FIGS. 3(*a*)-(*c*). However, in contrast to the embodiment of FIGS. 3(*a*)-(*c*), locking mechanism 460 is integrated with raised portion 414. In this embodiment, locking mechanism 460 includes buttons 462 and 463. When button 463 is depressed, the spring inside raised portion 414 is impeded from pulling more of cord 450 back into raised portion 414 (i.e., the cord is "locked"). However, when button 462 is depressed, the spring inside raised portion 414 is able to pull more of cord 450 back into raised portion 414 (i.e., the cord is "unlocked"). In this embodiment, when button 462 is depressed, button 463 is pushed outwardly to an undepressed state. Similarly, when button 463 is depressed, button 462 is pushed outwardly to an undepressed state.

FIGS. 5(*a*)-(*d*) illustrate another embodiment of a toilet flapper. More specifically, FIG. 5(*a*) illustrates a fully assembled toilet flapper 500. FIG. 5(*b*) provides an exploded view of toilet flapper 500. FIGS. 5(*c*) and 5(*d*) illustrate different views of a subset of the components of toilet flapper 500. As shown, toilet flapper 500 includes float 510, seal 520, frame 530, retractable cord reel 540, spring 550, lock pin 560, cap 570, and lever 580. Frame 530 includes arms 532 and 534, which may be used to moveably attach toilet flapper 500 to an overflow pipe near the drain hole of the water tank of a toilet. The overflow pipe (not shown) typically has some sort of structure to which the toilet flapper structure is removably attached. Frame 530 also includes a top surface 536 and a bottom surface (not shown). The top surface 536 includes a guide structure 590 through which a cord 542 of retractable cord reel 540 may be pulled by a user. In some embodiments, a hook or other similar structure may be attached to cord 542. As described above with reference to other embodiments (e.g., hook 130 of FIG. 1), the hook or other similar mechanism may be connected to a flush lever by a user during installation of toilet flapper 500.

In some embodiments, various components of toilet flapper 500, such as float 510, frame 530, cord 542, lock pin 560, cap 570, and lever 580, may be constructed with a water-resistant material, such as stainless steel or plastic. In some embodiments, seal 520 may be constructed with a rubber material. In some embodiments, cord 542 may be constructed as one continuous line of material and, in other embodiments, cord 542 may have one or more discontinuities, such as a chain comprising a plurality of links. As shown, many of the components of toilet flapper 500 are discrete structures. However, in other embodiments, one or more of these components may be separate portions of a unitary structure. For example, as shown, frame 530 and cap 570 are discrete structures. However, in other embodiments, frame 530 and cover 570 may be separate portions of a unitary structure.

As shown in FIG. 5(*b*), retractable cord reel 540 comprises a housing 544 with a hole 546. In some embodiments, housing 544 may contain a spiral torsion spring that is attached to cord 542. When assembled, a portion of lock pin 560 may extend into housing 544 of retractable cord reel 540 through hole 546. Spring 550 may be configured to exert a downward force on lock pin 560 to keep a portion of lock pin 560 within housing 544. When a portion of lock pin 560 extends into housing 544, cord 542 may be impeded from (a) retracting back into retractable cord reel 540 (e.g., from a force exerted by a spiral torsion spring in retractable cord reel 540) or (b) being pulled out of retractable cord reel 540 by a user. However, a user may press down on lever 580 to exert an opposing upward force on lock pin 560 in order to partially or completely lift it out of housing 544 and permit cord 542 (*a*) to retract back into retractable cord reel 540 (e.g., from a force exerted by a spiral torsion spring in retractable cord reel 540) or (b) to be pulled out of retractable cord reel 540 by the user.

As shown in FIG. 5(*c*), top surface 536 of frame 530 includes a recess 538. Recess 538 is configured to receive retractable cord reel 540. During assembly, after retractable cord reel 540 is placed in recess 538, cap 570 is placed over retractable cord reel 540 to cover it. In this embodiment, cover 570 almost entirely covers retractable cord reel 540. However, in other embodiments, cover 570 may be configured to cover more or less of retractable cord reel 540. In some embodiments one or more components of cover 570 may be configured to engage one or more complementary components (e.g., indents, ridges, threads, etc.) of frame 530 that surround recess 538 to form a connection with frame 530. In some embodiments, cover 570 may be connected to frame 530 through the use of an adhesive.

As shown in FIG. 5(*d*), float 510 comprises an aperture 512 and frame 530 comprises a complementary aperture 539. In some embodiments, apertures 512 and 539 may have a similar size and shape. In some embodiments, float 510 and frame 530 may be rotated relative to each other in order to further align or misalign apertures 512 and 539. For example, as shown in FIG. 5(*d*), apertures 512 and 539 are aligned such that frame 530 does not cover most of aperture 512. However, in some embodiments, float 510 and frame 530 may be rotated relative to each other such that apertures 512 and 539 are misaligned and frame 530 covers a larger portion of aperture 512. Providing a rotating float 510 and/or frame 530 as illustrated allows the user to adjust the amount of water that is flushed by a toilet having toilet flapper 500 installed therein.

As also shown in FIG. 5(*d*), guide structure 590 is c-shaped. As a result, guide structure includes an aperture 592 and a gap 594. During installation, cord 542 is pulled through aperture 592 by a user. Furthermore, a user can remove cord 542 from guide structure 590 by sliding cord 542 through gap 594. As mentioned above, cord 542 may be attached to a hook or another similar mechanism. In some embodiments, the hook or other similar mechanism attached to cord 542 may be too large to fit through aperture 592. In those embodiments, gap 594 is particularly advantageous because it allows cord 542 to be inserted into aperture 592 without requiring the hook to pass through aperture 592.

In other embodiments, guide structure 590 may have another shape that is also suitable for redirecting cord 542. For example, guide structure 590 may have a continuous perimeter without any gaps. For example, guide structure may be o-shaped and have a single aperture through which cord 542 may be pulled through. Similarly, in other embodiments, guide structure 590 may be angled differently. For example, as shown in FIGS. 5(*a*)-(*d*), the angle between top surface 536 and guide structure 590 is approximately 90 degrees. However, this angle could be reduced, for example, to 45 degrees or anywhere in between. Furthermore, in other embodiments, toilet flapper 500 may include multiple guide structures for redirecting cord 542. For example, an additional guide structure could be placed between cap 570 and guide structure 590.

FIGS. 6(*a*)-(*d*) illustrate another embodiment of a toilet flapper. More specifically, FIG. 6(*a*) illustrates a partially assembled toilet flapper 600. FIG. 6(*b*) provides an exploded view of a subset of the components of toilet flapper 600. FIGS. 6(*c*) and 6(*d*) provide cross-sectional views of a subset of the components of toilet flapper 600. As shown, toilet flapper 600 includes float 610, frame 630, cord 642, lock pin 660, and cap 670. Frame 630 includes arms 632 and 634, which may be used to moveably attach toilet flapper 600 to an overflow pipe near the drain hole of the water tank of a toilet. The overflow pipe (not shown) typically has some sort of structure to which the toilet flapper structure is removably attached. In some embodiments, a hook or another similar structure may be attached to cord 642. As described above with reference to other embodiments (e.g., hook 130 of FIG. 1), the hook or other similar mechanism may be connected to a flush lever by a user during installation of toilet flapper 600.

In some embodiments, various components of toilet flapper 600, such as float 610, frame 630, cord 642, lock pin 660, and cap 670, may be constructed with a water-resistant material, such as stainless steel or plastic. In some embodiments, cord 642 may be constructed as one continuous line of material and, in other embodiments, cord 642 may have one or more discontinuities, such as a chain comprising a plurality of links. As shown, many of the components of toilet flapper 600 are discrete structures. However, in other embodiments, one or more of these components may be separate portions of a unitary structure. For example, as shown, frame 630 and cap 670 are discrete structures. However, in other embodiments, frame 630 and cover 670 may be separate portions of a unitary structure.

As shown in FIG. 6(*b*), frame 630 includes a recess 638. Recess 638 is configured to receive a retractable cord reel (not shown). The retractable cord reel may house a portion of cord 542. During assembly, after a retractable cord reel is placed in recess 638, cap 670 is placed over retractable cord reel 640 to cover it. In this embodiment, cover 670 will almost entirely cover the retractable cord reel. However, in other embodiments, cover 670 may be configured to cover more or less of the retractable cord reel. In some embodiments one or more components of cover 670 may be configured to engage one or more complementary components (e.g., indents, ridges, threads, etc.) of frame 630 that surround recess 638 to form a connection with frame 630. In some embodiments, cover 670 may be connected to frame 630 through the use of an adhesive.

When assembled, lock pin 660 of toilet flapper 600 may be used in much the same way as lock pin 560 of toilet flapper 500 of FIGS. 5(*a*)-(*d*). For example, a retractable cord reel (not shown) housed between frame 630 and cover 670 may have a structure that is similar to cord reel 540. As a result, it may include a hole through which lock pin 660 may extend. When assembled, the hole in the retractable cord reel may be aligned with hole 672 in cover 670. Furthermore, lock pin 660 may be configured such that a spring (not shown) exerts an inward force that pushes a portion of lock pin 660 through hole 672 and into the retractable cord reel. The spring may be positioned between handle 662 of lock pin 660 and stopper 674 of cover 670. When a portion of lock pin 660 extends into the retractable cord reel in this manner, cord 642 may be impeded from (a) retracting back into the retractable cord reel (e.g., from a force exerted by a spiral torsion spring in the retractable cord reel) or (b) being pulled out of the retractable cord reel by a user. However, a user may apply an opposing outward force on handle 662 in order to partially or completely pull lock pin 660 out of the retractable cord reel and permit cord 642 (*a*) to retract back into the retractable cord reel (e.g., from a force exerted by a spiral torsion spring in the retractable cord reel) or (b) to be pulled out of the retractable cord reel by the user. As shown, a portion of lock pin 660 slides in and out of hole 676 in stopper 674 during the operations described above.

As shown in FIGS. 6(*a*) and 6(*b*), frame 630 comprises apertures 639A, 639B, and 639C. Furthermore, as shown in FIGS. 6(*c*) and 6(*d*), float 610 comprises a complementary set of apertures (e.g., apertures 612B and 612C). In some embodiments, these apertures may have a similar size and shape. Furthermore, in some embodiments, float 610 and frame 630 may be rotated relative to each other in order to further align or misalign these apertures. For example, as shown in FIGS. 6(*c*) and 6(*d*), apertures 612B and 639B are aligned such that frame 630 does not cover most of aperture 612B. However, in some embodiments, float 610 and frame 630 may be rotated relative to each other such that apertures 612B and 639B are misaligned and frame 630 covers a larger portion of aperture 612B. Providing a rotating float 610 and/or frame 630 as illustrated allows the user to adjust the amount of water that is flushed by a toilet having toilet flapper 600 installed therein.

One notable distinction between toilet flapper 500 of FIGS. 5(*a*)-(*d*) and toilet flapper 600 of FIGS. 6(*a*)-(*d*) is the orientation at which a retractable cord reel is housed. In the embodiment of FIGS. 5(*a*)-(*d*), retractable cord reel 540 is housed between frame 530 and cover 570 of toilet flapper 500 in a generally horizontal orientation. In contrast, in the embodiment of FIGS. 6(*a*)-(*d*), a retractable cord reel is housed between frame 630 and cover 670 of toilet flapper 600 in a generally vertical orientation. As result, a larger portion of the retractable cord reel extends downward into the airspace of float 610. This is readily apparent in the cross-sectional view of FIG. 6(*c*) where the extent to which recess 638 extends downward into the airspace of float 610 is shown. Furthermore, as shown in FIG. 6(*d*), recess 638 is oriented such that there is a space of 0.935 inches between a wall of recess 638 and aperture 639B.

FIGS. 7(*a*)-(*i*) illustrate another embodiment of a toilet flapper. More specifically, FIG. 7(*a*) illustrates a partially assembled toilet flapper 700. FIG. 7(*b*) provides an exploded view of a subset of the components of toilet flapper 700. FIGS. 7(*c*) and 7(*d*) provide cross-sectional views of a subset of the components of toilet flapper 700. FIG. 7(*e*) provides a cross-sectional view of toilet flapper 700 attached to an overflow pipe. FIGS. 7(*f*) and 7(*g*) provide an exploded view of a retractable cord reel 740 of toilet flapper 700. FIG. 7(*h*) provides a cross-sectional view of a subset of the components of toilet flapper 700 while toilet flapper 700 is in a locked position. FIG. 7(*i*) provides a cross-sectional view of a subset of the components of toilet flapper 700 while toilet flapper 700 is in an unlocked position.

As shown, toilet flapper 700 includes float 710, frame 730, retractable cord reel 740, spring 750, lock pin 760, and cap 770. Frame 730 includes arms 732 and 734, which may be used to moveably attach toilet flapper 700 to an overflow pipe (e.g., overflow pipe 702) near the drain hole (e.g., drain hole 704) of the water tank of a toilet. The overflow pipe typically has some sort of structure to which the toilet flapper structure is removably attached. In some embodiments, a hook or another similar structure may be attached to a cord 742 partially housed within retractable cord reel 740. As described above with reference to other embodiments (e.g., hook 130 of FIG. 1), the hook or other similar mechanism may be connected to a flush lever by a user during installation of toilet flapper 700.

In some embodiments, various components of toilet flapper 700, such as float 710, frame 730, cord 742, lock pin 760, and cap 770, may be constructed with a water-resistant material, such as stainless steel or plastic. In some embodiments, cord 742 may be constructed as one continuous line of material and, in other embodiments, cord 742 may have one or more discontinuities, such as a chain comprising a plurality of links. As shown, many of the components of toilet flapper 700 are discrete structures. However, in other embodiments, one or more of these components may be separate portions of a unitary structure. For example, as shown, frame 730 and cap 770 are discrete structures. However, in other embodiments, frame 730 and cover 770 may be separate portions of a unitary structure.

As shown in FIG. 7(*b*), frame 730 includes a recess 738. Recess 738 is configured to receive retractable cord reel 740. Retractable cord reel 740 may house a portion of cord 542. During assembly, after retractable cord reel 740 is placed in recess 738, cap 770 is placed over retractable cord reel 740 to cover it. In this embodiment, cover 770 will almost entirely cover retractable cord reel 740. However, in other embodiments, cover 770 may be configured to cover more or less of retractable cord reel 740. In some embodiments one or more components of cover 770 may be configured to engage one or more complementary components (e.g., indents, ridges, threads, etc.) of frame 730 that surround recess 738 to form a connection with frame 730. In some embodiments, cover 770 may be connected to frame 730 through the use of an adhesive.

When assembled, lock pin 760 of toilet flapper 700 may be used in much the same way as lock pins 560 and 660 of toilet flappers 500 and 600, respectively. For example, a hole 746 in retractable cord reel 740 may be aligned with hole 772 in cover 770. Furthermore, lock pin 760 may be configured such that a spring 750 exerts an inward force that pushes a portion of lock pin 760 through hole 772 and into retractable cord reel 740. Spring 750 may be positioned between handle 762 of lock pin 760 and stopper 774 of cover 770. When a portion of lock pin 760 extends into retractable cord reel 740 in this manner, cord 742 may be impeded from (a) retracting back into retractable cord reel 740 (e.g., from a force exerted by a spiral torsion spring in retractable cord reel 740) or (b) being pulled out of retractable cord reel 740 by a user. However, a user may apply an opposing outward force on handle 762 in order to partially or completely pull lock pin 760 out of retractable cord reel 740 and permit cord 742 (*a*) to retract back into retractable cord reel 740 (e.g., from a force exerted by a spiral torsion spring in retractable cord reel 740) or (b) to be pulled out of retractable cord reel 740 by the user. As shown, a portion of lock pin 760 slides in and out of hole 776 in stopper 774 during the operations described above.

Additional details regarding the structure of retractable cord reel 740 are shown in FIGS. 7(*f*)-(*i*). As shown in FIG. 7(*f*), a portion of a housing 744 of retractable cord reel 740 is transparent to illustrate how lock pin 760 accomplishes the functions described above. As shown, when a portion of lock pin 760 enters housing 744, it may contact a guide plate 748. Guide plate 748 includes a plurality of radial ribs 749. FIG. 7(*g*) illustrates guide plate 748 in isolation. Guide plate 748 may be connected to cord 742 such that when a portion of cord 742 is pulled out of retractable cord reel 742 or when a portion of cord 742 is retracted back into retractable cord reel 742, guide plate 748 rotates in a clockwise or counter-clockwise direction. When lock pin 760 contacts guide plate 748, the rotation of guide plate 748 is impeded as one of the plurality of radial ribs 749 contacts lock pin 760. FIG. 7(*h*) is a cross-sectional view of toilet flapper 700 when lock pin 760 is in a locked position such as this. FIG. 7(*i*) is a cross-sectional view of toilet flapper 700 when lock pin 760 is in an unlocked position where guide plate 748 may rotate freely. In this particular embodiment, each of the plurality of radial ribs 749 of guide plate 748 has a uniform height. However, in other embodiments, one or more of the plurality of radial ribs 749 may have a non-uniform height. For example, one or more of the plurality of radial ribs 749 may have a gradually decreasing height.

As shown in FIGS. 7(*a*) and 7(*b*), frame 730 comprises apertures 739A, 739B, and 739C. Furthermore, as shown in FIGS. 7(*c*) and 7(*d*), float 710 comprises a complementary set of apertures (e.g., apertures 712B and 712C). In some embodiments, these apertures may have a similar size and shape. Furthermore, in some embodiments, float 710 and frame 730 may be rotated relative to each other in order to further align or misalign these apertures. For example, as shown in FIGS. 7(*c*) and 7(*d*), apertures 712B and 739B are aligned such that frame 730 does not cover most of aperture 712B. However, in some embodiments, float 710 and frame 730 may be rotated relative to each other such that apertures 712B and 739B are misaligned and frame 730 covers a larger portion of aperture 712B. Providing a rotating float 710 and/or frame 730 as illustrated allows the user to adjust the amount of water that is flushed by a toilet having toilet flapper 700 installed therein.

As shown in FIG. 7(*e*), when toilet flapper 700 is attached to an overflow pipe (e.g., overflow pipe 702), it may be raised to a fully open position. When in a fully open position, an opening angle θ is formed between toilet flapper 700 and a drain hole 704. In some embodiments opening angle θ may within a range of 55 to 75 degrees. For example, opening angle θ may be approximately 69 degrees. In the embodiment of FIGS. 7(*a*)-(*i*), opening angle θ is increased by the inclusion of cutouts 731 and 771 in frame 730 and cover 770, respectively.

One notable distinction between toilet flapper 600 of FIGS. 6(*a*)-(*d*) and toilet flapper 700 of FIGS. 7(*a*)-(*i*) is the inclusion of guide structure 790. As shown, guide structure 790 is c-shaped. As a result, guide structure 790 includes an aperture 792 and a gap 794. Guide structure 790 is also positioned on cap 770. During installation, cord 742 is pulled through aperture 792 by a user. Furthermore, a user can remove cord 742 from guide structure 790 by sliding cord 742 through gap 794. As mentioned above, cord 742 may be attached to a hook or another similar mechanism. In some embodiments, the hook or other similar mechanism attached to cord 742 may be too large to fit through aperture 792. In those embodiments, gap 794 is particularly advantageous because it allows cord 742 to be inserted into aperture 792 without requiring the hook to pass through aperture 792.

In other embodiments, guide structure 790 may have another shape that is also suitable for redirecting cord 742. For example, guide structure 790 may have a continuous perimeter without any gaps. For example, guide structure may be o-shaped and have a single aperture through which cord 742 may be pulled through. Similarly, in other embodiments, guide structure 790 may be angled differently. For example, as shown in FIGS. 7(*a*)-(*i*), the angle between top surface 736 and guide structure 790 is approximately 90 degrees. However, this angle could be reduced, for example, to 45 degrees or anywhere in between. Furthermore, in other embodiments, toilet flapper 700 may include multiple guide structures for redirecting cord 742.

Another notable distinction between toilet flapper 600 of FIGS. 6(*a*)-(*d*) and toilet flapper 700 of FIGS. 7(*a*)-(*i*) is the orientation at which a retractable cord reel is housed. In both embodiments, the retractable cord reel is housed in a generally horizontal orientation. However, in the embodiment of FIGS. 7(*a*)-(*i*), retractable cord reel 740 is rotated approximately 90 degrees relative to retractable cord reel 640. As a result, the space between a wall of recess 738 and aperture 739B is only 0.176 inches. Therefore, the amount of water than can flow into float 710 through apertures 712B and 739B during operation is restricted.

Figure 8:
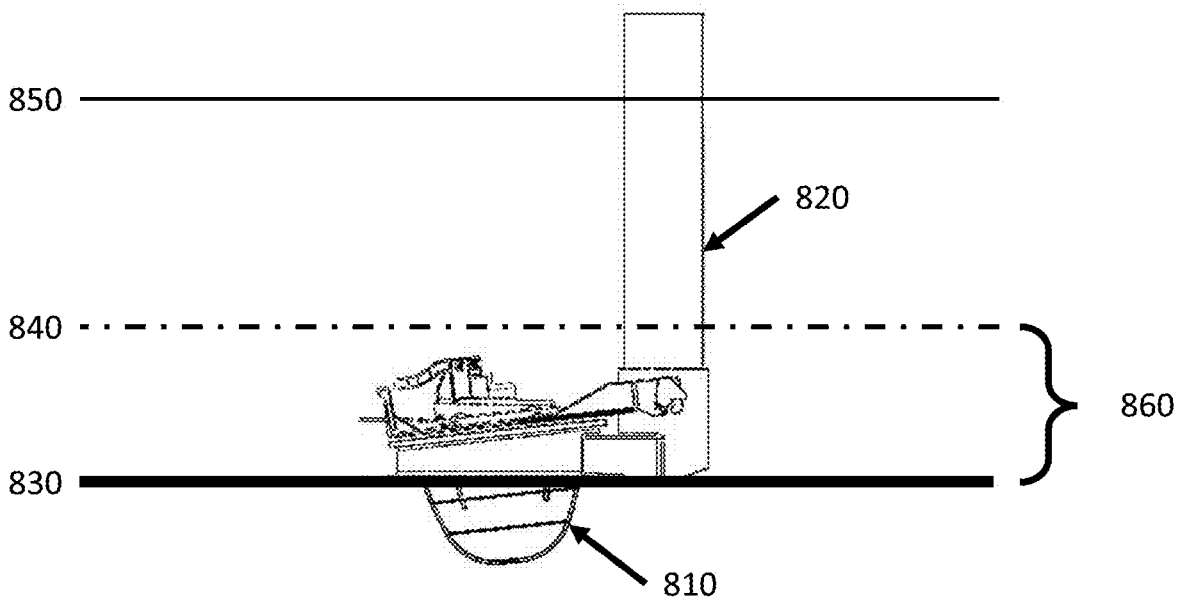
FIG. 8 illustrates a setup for a residual water level test.

FIG. 8 illustrates a setup for a residual water level test. As shown, a toilet flapper 810 may be positioned within the tank of a toilet and attached to an overflow pipe 820. The tank of the toilet has a base 830 with a drain. Toilet flapper 810 is positioned on that drain so that it can retain water in the tank of the toilet. Before the toilet is flushed, the tank has an initial water level 850. After the toilet is flushed, the tank has a residual water level 840. Residual water level tests were performed on several of the embodiments described above. At the conclusion of these tests, it was observed that a prototype of toilet flapper 500 of FIGS. 5(*a*)-(*d*) exhibited some particularly advantageous characteristics. For example, when float 510 was fully closed (e.g., when apertures 512 and 539 do not overlap), a residual water level of only 75 mm was measured. In contrast, when float 710 of a prototype of toilet flapper 700 of FIGS. 7(*a*)-(*i*) was fully closed (e.g., when apertures 712B and 739B do not overlap), a residual water level of 85 mm was measured. Some of the structural distinctions that affected the residual water level included the weights of these toilet flappers and the amount of airspace in the floats of these toilet flappers. In comparison to toilet flapper 700, toilet flapper 500 has an increased amount of airspace in float 510. Furthermore, in comparison to toilet flapper 700, toilet flapper 500 weighs less. This was due in part to the fact that the prototype of toilet flapper 500 included a smaller and lighter retractable cord reel.

Figure 9A:
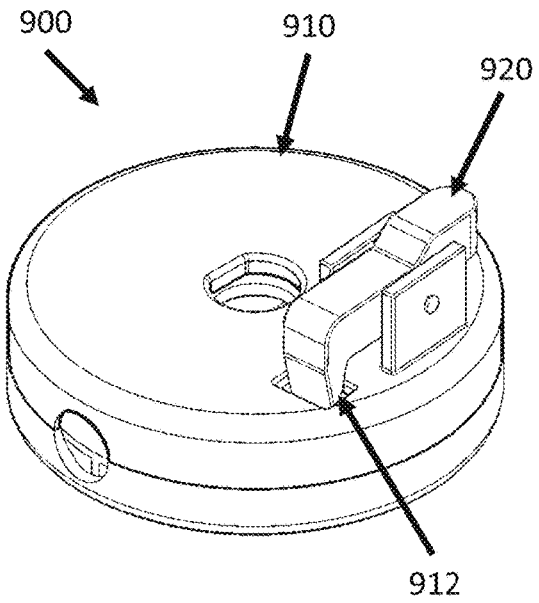
FIG. 9(*a*) illustrates an embodiment of a retractable cord reel as described herein.
Figure 9B:
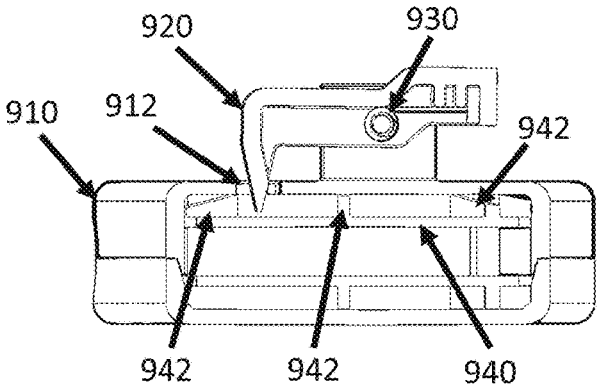
Figure 9C:
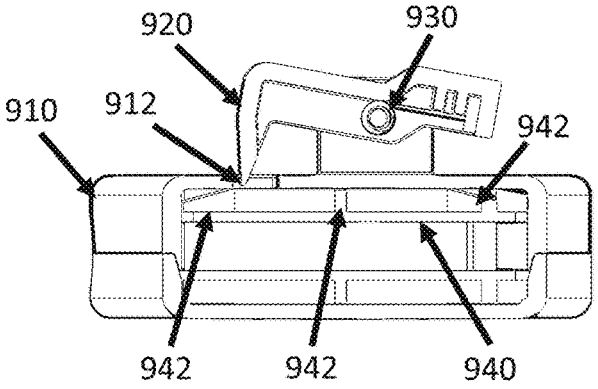

In many of the embodiments described above, a cord is stored directly in a toilet flapper. However, in some embodiments, a cord may be stored in a separate device from the toilet flapper. For example, as shown in FIGS. 9(*a*)-(*c*), a cord may be stored in a retractable cord reel 900. As shown, retractable cord reel 900 includes housing 910, lock pin 920, torsion spring 930, and guide plate 940. Housing 910 includes a hole 912 though which a portion of lock pin 920 may extend. Guide plate 940 includes a plurality of radial ribs 942. As shown, each of the plurality of radial ribs 942 has a gradually decreasing height. However, in other embodiments, one or more of the plurality of radial ribs 942 may have a uniform height and/or a different type of non-uniform height. As shown, guide plate 940 is housed in housing 910. Guide plate 940 is also connected to a cord (not shown) that is partially housed in retractable cord reel 900 such that when a portion of the cord is pulled out of retractable cord reel 900 or when a portion of the cord is retracted back into retractable cord reel 900, guide plate 940 rotates in a clockwise or counter-clockwise direction.

Retractable cord reel 900 may operate in much the same way as retractable cord reel 740 of FIGS. 7(*f*)-(*i*). For example, torsion spring 930 may be configured to exert a downward force on lock pin 920 to keep a portion of lock pin 920 within housing 910. When a portion of lock pin 920 extends into retractable cord reel 900 through hole 912, a cord (not shown) may be impeded from (a) retracting back into retractable cord reel 900 (e.g., from a force exerted by a spiral torsion spring in retractable cord reel 900) or (b) being pulled out of retractable cord reel 900 by a user. For example, as shown in FIG. 9(*b*), when in a locked positioned, lock pin 920 may extend far enough into housing 910 such that one of the plurality of radial ribs 942 will contact lock pin 920 as guide plate 940 rotates. However, a user may apply an opposing force on lock pin 920 in order to partially or completely pull lock pin 920 out of retractable cord reel 900 and permit the cord (a) to retract back into retractable cord reel 900 (e.g., from a force exerted by a spiral torsion spring in retractable cord reel 900) or (b) to be pulled out of retractable cord reel 900 by the user. For example, as shown in FIG. 9(*c*), when in an unlocked position, most of lock pin 920 is positioned outside of housing 910. As a result, guide plate 940 is able to rotate freely.

Figure 10C:
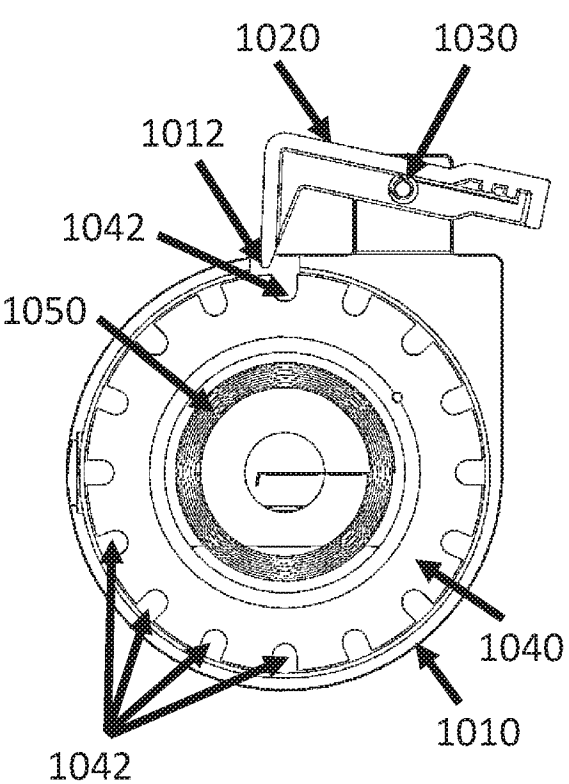
FIG. 10(*a*) illustrates an embodiment of a retractable cord reel as described herein.
Figure 10B:
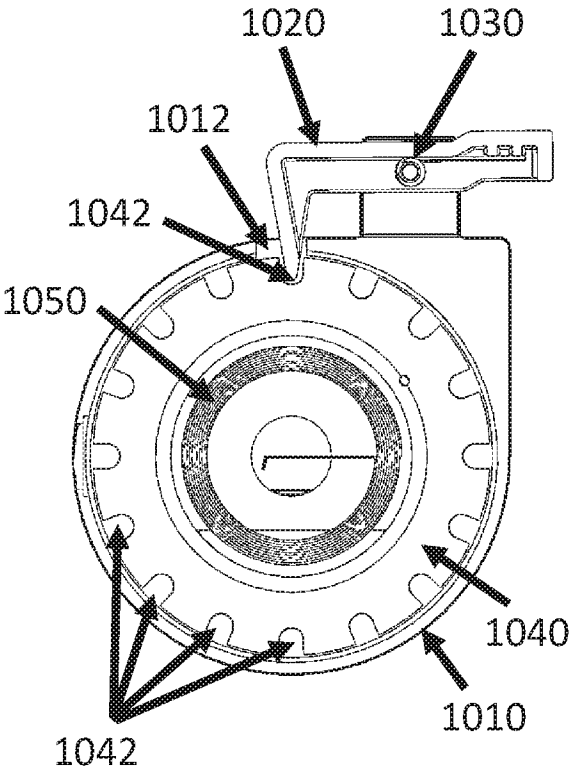
Figure 10A:
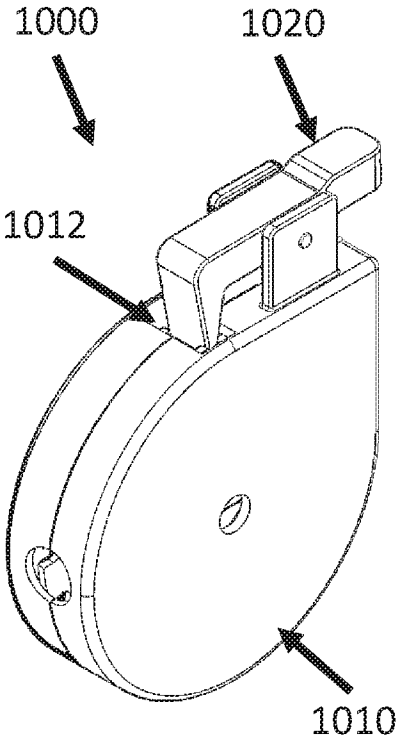

As another example, as shown in FIGS. 10(*a*)-(*c*), a cord may be stored in a retractable cord reel 1000. As shown, retractable cord reel 1000 includes housing 1010, lock pin 1020, torsion spring 1030, and guide plate 1040. Housing 1010 includes a hole 1012 through which a portion of lock pin 1020 may extend. Guide plate 1040 includes a plurality of cutouts 1042. As shown, each of the plurality of cutouts 1042 has a half obround or semi oval shape. However, in other embodiments, one or more of the plurality of cutouts 1042 may have a different type of shape (e.g., rectangular, circular, triangular, etc.). As shown, guide plate 1040 is housed in housing 1010. Guide plate 1040 is also connected to a cord (not shown) that is partially housed in retractable cord reel 1000 such that when a portion of the cord is pulled out of retractable cord reel 1000 or when a portion of the cord is retracted back into retractable cord reel 1000, guide plate 1040 rotates in a clockwise or counter-clockwise direction.

Retractable cord reel 1000 may operate in much the same way as retractable cord reel 900 of FIGS. 9(*a*)-(*c*). For example, torsion spring 1030 may be configured to exert a downward force on lock pin 1020 to keep a portion of lock pin 1020 within housing 1010. When a portion of lock pin 1020 extends into retractable cord reel 1000 through hole 1012, a cord (not shown) may be impeded from (a) retracting back into retractable cord reel 1000 (e.g., from a force exerted by a-spiral torsion spring 1050 in retractable cord reel 1000) or (b) being pulled out of retractable cord reel 1000 by a user. For example, as shown in FIG. 10(*b*), when in a locked positioned, lock pin 1020 may extend through hole 1012 and into one of the plurality of cutouts 1042 of guide plate 1040. However, a user may apply an opposing force on lock pin 1020 in order to partially or completely pull lock pin 1020 out of retractable cord reel 1000 and permit the cord (a) to retract back into retractable cord reel 1000 (e.g., from a force exerted by spiral torsion spring 1050 in retractable cord reel 1000) or (b) to be pulled out of retractable cord reel 1000 by the user. For example, as shown in FIG. 10(*c*), when in an unlocked position, most of lock pin 1020 is positioned outside of housing 1010. As a result, guide plate 1040 is able to rotate freely.

In other embodiments, different types of locking mechanisms may be incorporated into variations of retractable cord reel 900 of FIGS. 9(*a*)-(*c*) and/or retractable cord reel 1000 of FIGS. 10(*a*)-(*c*). For example, a separate retractable cord reel may include a locking mechanism that is structured much like locking mechanism 360 of FIGS. 3(*a*)-(*c*). Such a locking mechanism may be positioned outside the retractable cord reel on a portion of the cord that is also outside the retractable cord reel. As another example, a separate retractable cord reel may include a raised portion and a locking mechanism that are structured much like raised portion 414 and locking mechanism of FIG. 4.

Figure 11:
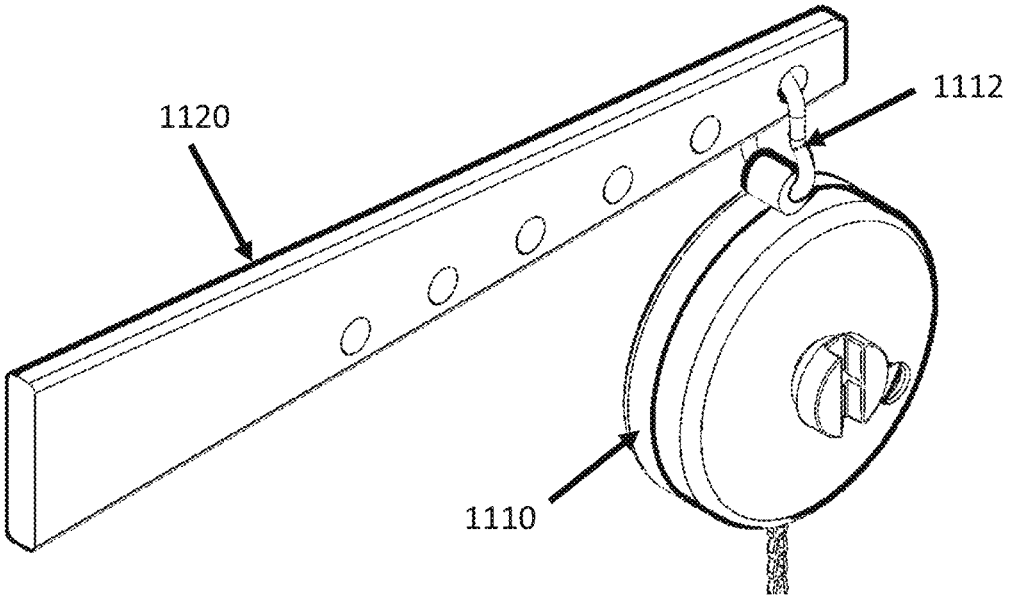
FIG. 11 illustrates a mechanism for attaching a device to a flush lever of a toilet.
Figure 12A:
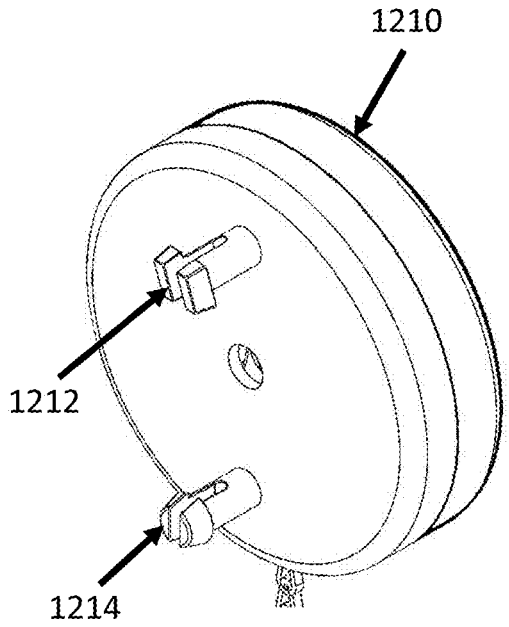
FIG. 12(*a*) illustrates a mechanism for attaching a device to a flush lever of a toilet.
Figure 12B:
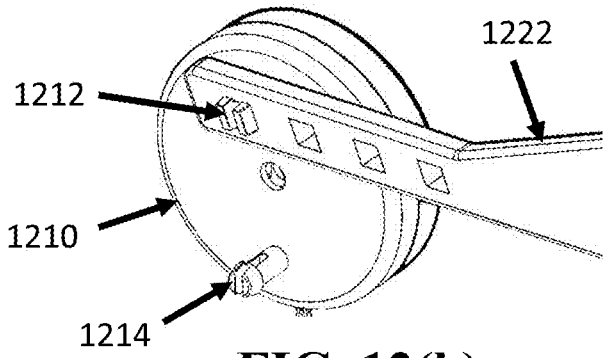
Figure 12C:
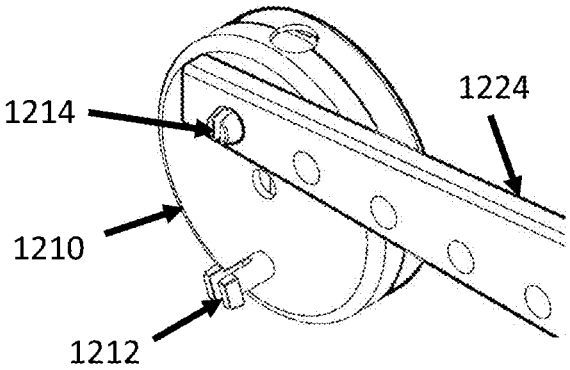

During installation of a separate device, such as retractable cord reel 900 of FIGS. 9(*a*)-(*c*) or retractable cord reel 1000 of FIGS. 10(*a*)-(*c*), a user may attach the separate device to a flush lever of a toilet. For example, as shown in FIG. 11, a user may attach a separate device 1110 to a flush lever 1120 through the use of a hook 1112. As another example, as shown in FIGS. 12(*a*)-(*c*), a user may attach a separate device 1210 to a flush lever through the use of a snap-fit joint (e.g., snap-fit joints 1212 and 1214). As shown, separate device 1210 includes a rectangular snap-fit joint 1212 and a circular snap-fit joint 1214. Conventional flush levers typically include rectangular or circular holes that can receive the snap fit joints. Snap-fit joints 1212 and 1214 may be configured to fit into one of these types of holes. As shown in FIG. 12(*b*), a user can attach separate device 1210 to a conventional flush lever 1222 through the use of rectangular snap-fit joint 1212. As shown in FIG. 12(*c*), a user can attach separate device 1210 to another conventional flush lever 1224 through the use of circular snap-fit joint 1214. In other embodiments, separate device 1210 may include additional snap-fit joints to accommodate other types of conventional flush levers.

Figure 13A:
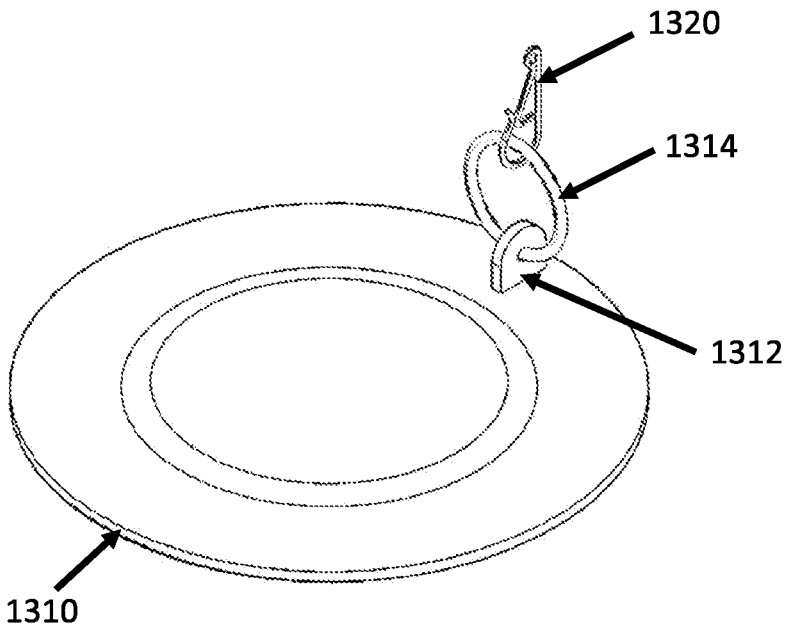
FIG. 13(*a*) illustrates a top surface of a conventional toilet flapper.
Figure 13B:
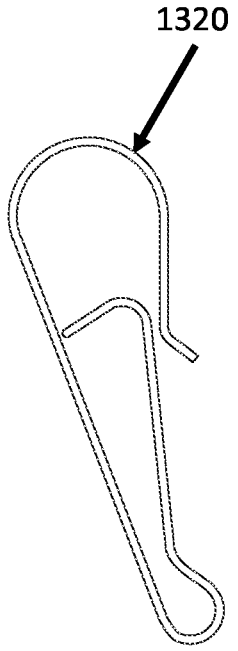

During installation of the separate device, a user may also pull a sufficient amount of a cord out of the separate device in order to connect the flush lever with a toilet flapper in the toilet. FIGS. 13(*a*) through 16(*b*) illustrate different ways in which a user may attach the cord of the separate device to the toilet flapper. For example, as shown in FIGS. 13(*a*) and 13(*b*), a user may connect the cord to the toilet flapper through the use of a hook 1320. As shown in FIG. 13(*a*), a top surface of a conventional toilet flapper 1310 may include an attachment structure 1312 and a ring 1314. During installation, hook 1320 may be attached to ring 1314.

Figure 14A:
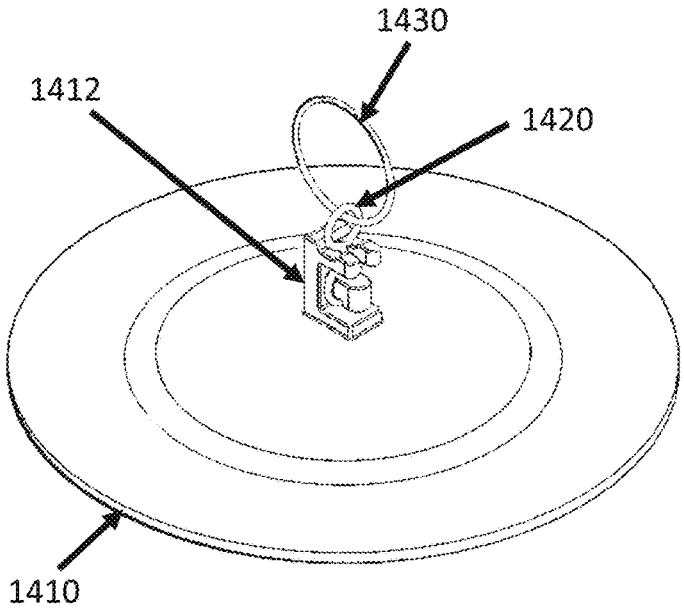
FIG. 14(*a*) illustrates a top surface of a conventional toilet flapper with a lock chain and ring attached thereto.
Figure 14B:
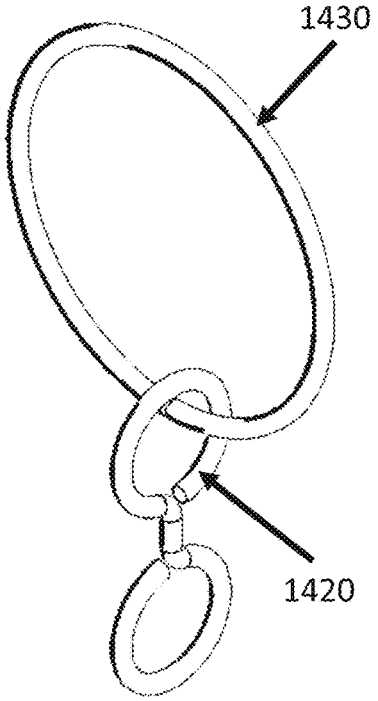

As another example, as shown in FIGS. 14(*a*) and 14(*b*), a user may connect the cord of the separate device to the toilet flapper through the use of a lock chain 1420 and a ring 1430. As shown in FIG. 14(*a*), a top surface of a conventional toilet flapper 1410 may include an attachment structure 1412. During installation, lock chain 1420 may be attached to attachment structure 1412. Ring 1430 may be integrated with the cord or attached to the cord through the use of a hook or another similar component.

Figure 15A:
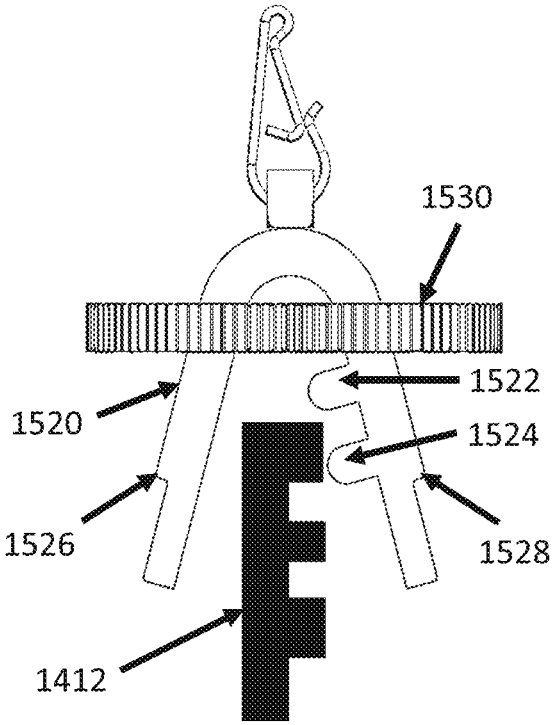
FIG. 15(*a*) illustrates a lock and a tightening ring used to attach a cord of a device to the toilet flapper of FIG. 14(*a*).
Figure 15B:
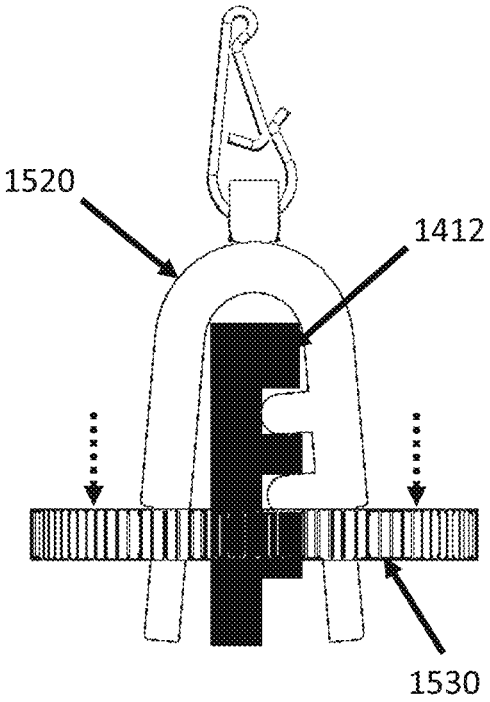

As yet another example, as shown in FIGS. 15(*a*) and 15(*b*), a user may connect the cord of the separate device to the toilet flapper through the use of a lock 1520 and a tightening ring 1530. Lock 1520 and tightening ring 1530 may be configured for use with a conventional toilet flapper such as the one illustrated in FIG. 14(*a*). For example, lock 1520 includes ridges 1522 and 1524 that are sized to fit within portions of attachment structure 1412. During installation, a user may slide lock 1520 over attachment structure 1412. Subsequently, the user may slide tightening ring down lock 1520. In combination with the resilience of lock 1520, ridges 1526 and 1528 impede tightening ring 1530 from sliding back up lock 1520. In some embodiments, lock 1520 and tightening ring 1530 may be constructed from a metal or plastic material.

Figure 16A:
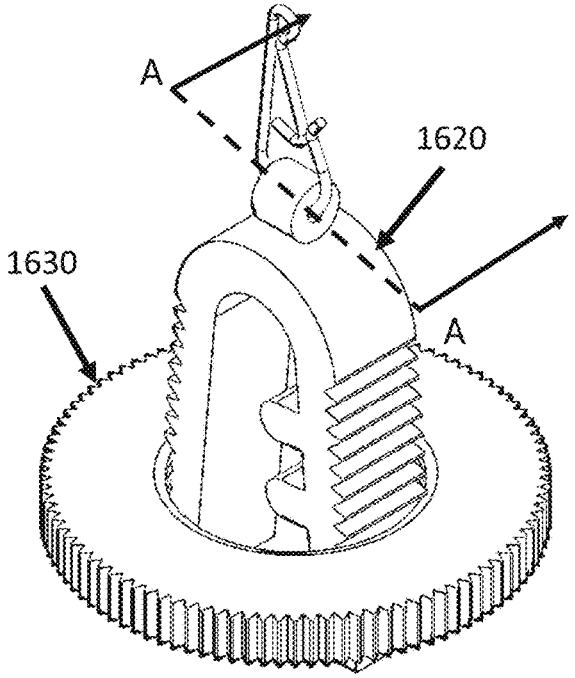
FIG. 16(*a*) illustrates how a lock and a tightening ring may be used to attach a cord of a device to the toilet flapper of FIG. 14(*a*).
Figure 16B:
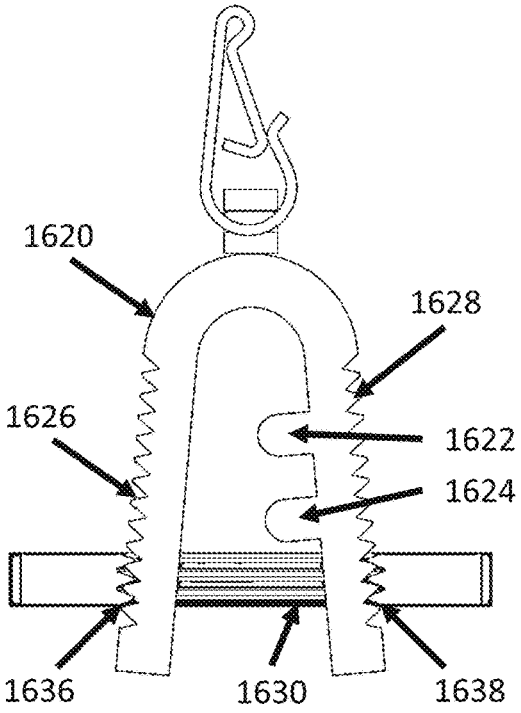

As yet another example, as shown in FIGS. 16(*a*) and 16(*b*), a user may connect the cord of the separate device to the toilet flapper through the use of a lock 1620 and a tightening ring 1630. Lock 1620 and tightening ring 1630 are structured similarly to lock 1520 and tightening ring 1530 of FIGS. 15(*a*) and 15(*b*). For example, lock 1620 includes ridges 1622 and 1624 that are sized to fit within portions of attachment structure 1412. However, ridges 1526 and 1528 have been replaced with threads 1626 and 1628. Furthermore, tightening ring 1630 includes complementary threads 1636 and 1638. During installation, a user may slide lock 1620 over attachment structure 1412 (see, e.g., FIG. 15(*b*)). Subsequently, the user may fasten tightening ring 1630 to lock 1620. In some embodiments, lock 1620 and tightening ring 1630 may be constructed from a metal or plastic material.

Figure 17A:
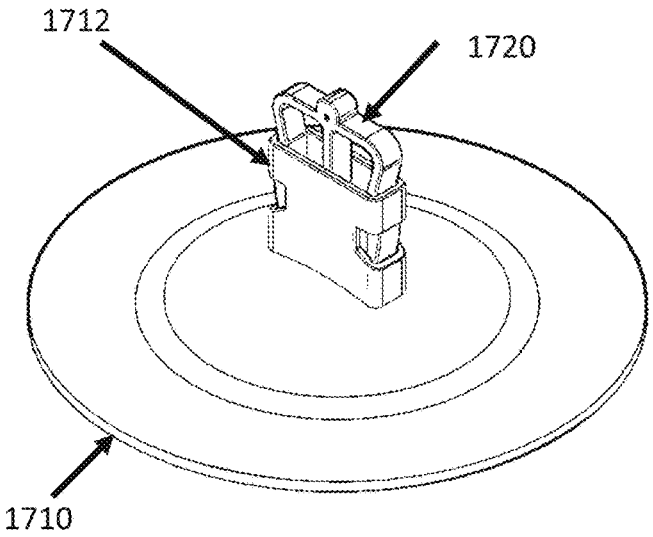
FIG. 17(*a*) illustrates a top surface of a non-conventional toilet flapper.
Figure 17B:
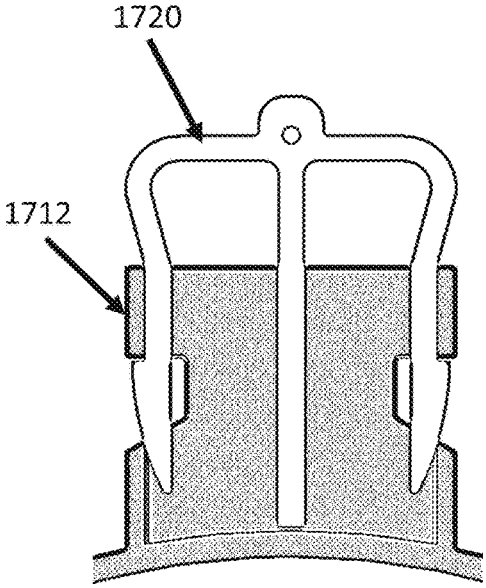

As yet another example, as shown in FIGS. 17(*a*) and 17(*b*), a user may connect the cord of the separate device to the toilet flapper through the use of a clip 1720. As shown, a top surface of a toilet flapper 1710 includes a non-conventional attachment structure 1712. During installation, a user may slide clip 1720 into attachment structure 1712. Clip 1720 may be integrated with the cord or attached to the cord through the use of a hook or another similar component.

From the foregoing and with reference to the various figure drawings, those skilled in the art will appreciate that certain modifications can also be made to the present disclosure without departing from the scope of the same. For example, in some embodiments, the cord may be replaced with a telescoping mechanism. Furthermore, while several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A toilet flapper comprising:

a frame having one or more arms configured to moveably attach the toilet flapper to an overflow pipe in a water tank of a toilet;

a cap positioned on a top surface of the frame;

a float positioned on a bottom surface of the frame;

a retractable cord reel positioned between the frame and the cap, wherein a cord and one or more springs are positioned in a housing of the retractable cord reel, wherein the retractable cord reel is configured such that a user can pull at least a portion of the cord out of the housing through an opening in the housing, wherein the one or more springs are configured to impart a retraction tension on the cord, and wherein the retraction tension causes the cord to be pulled back into the housing in the absence of an opposing force that overcomes the retraction tension; and a locking mechanism configured to impart a locking tension on the cord that is equal to or greater than the retraction tension and prevents the cord from retracting back into the housing.

2. The toilet flapper of claim 1 further comprising:

a guide structure having an aperture through which the cord may be pulled by a user.

3. The toilet flapper of claim 2, wherein the guide structure is positioned on the top surface of the frame.

4. The toilet flapper of claim 2, wherein the guide structure is positioned on the cap.

5. The toilet flapper of claim 2, wherein the guide structure is c-shaped.

6. The toilet flapper of claim 2, wherein the guide structure is o-shaped.

7. The toilet flapper of claim 1, wherein the locking mechanism is configured to impart the locking tension through a lock pin and at least one further spring, and wherein the at least one further spring is configured to push a portion of the lock pin through a further opening in the housing of the retractable cord reel.

8. The toilet flapper of claim 7, wherein a guide plate is also housed in the retractable cord reel, wherein the guide plate is connected to the cord, and wherein the locking mechanism is configured to impart the locking tension when the lock pin contacts the guide plate and impedes rotation of the guide plate.

9. The toilet flapper of claim 8, wherein the guide plate comprises one or more radial ribs.

10. The toilet flapper of claim 8, wherein the guide plate comprises one or more cutouts.

11. The toilet flapper of claim 10, wherein at least one of the cutouts has a half obround or semi oval shape.

12. The toilet flapper of claim 1, wherein the frame further comprises a recess configured to receive the retractable cord reel.

13. The toilet flapper of claim 1, wherein the retractable cord reel is positioned between the frame and the cap in a generally vertical orientation.

14. The toilet flapper of claim 1, wherein the retractable cord reel is positioned between the frame and the cap in a generally horizontal orientation.

15. The toilet flapper of claim 14 wherein the frame further comprises a first aperture and the float comprises a complementary second aperture, wherein the frame and the float are rotatably engaged, and wherein rotating the frame and the float relative to each other adjusts the alignment of the first and second apertures.

16. The toilet flapper of claim 15 further comprising:

a seal positioned on the bottom surface of the frame and around the float.

17. The toilet flapper of claim 16, wherein the seal is positioned above the first aperture of the frame and the second aperture of the float.

18. The toilet flapper of claim 1, wherein the cord is a continuous line of material.

19. The toilet flapper of claim 1, wherein the cord comprises a plurality of interconnected segments of material.

20. The toilet flapper of claim 19, wherein the cord comprises a chain having a plurality of links.

21. A method comprising:

attaching one or more arms of a toilet flapper to an overflow pipe in a water tank of a toilet;

attaching a housing of a retractable cord reel to a flush lever in the water tank of the toilet with a first attachment mechanism, wherein a portion of a cord and one or more springs are positioned in the housing, and wherein the one or more springs are configured to impart a retraction tension on the cord;

pulling at least some of the portion of the cord out of the housing through an opening in the housing with a force greater than the retraction tension;

attaching the cord to an attachment structure of the toilet flapper with a second attachment mechanism; and placing a locking mechanism in a locked position in which the locking mechanism imparts a locking tension on the cord that is equal to or greater than the retraction tension, and prevents the at least some of the portion of the cord from being pulled back into the housing by the retraction tension.

22. The method of claim 21, wherein the first attachment mechanism comprises a rectangular snap-fit joint or a circular snap-fit joint.

23. The method of claim 21, wherein the first or second attachment mechanism comprises a hook.

24. The method of claim 21, wherein the second attachment mechanism comprises a lock and a tightening ring.

25. The method of claim 21, wherein the second attachment mechanism comprises a clip configured to slide into the attachment structure of the toilet flapper.

* * * * *